US009307849B2

(12) United States Patent
Uhl

(10) Patent No.: US 9,307,849 B2
(45) Date of Patent: Apr. 12, 2016

(54) MODULAR MIRROR CHASSIS APPARATUSES AND METHODS

(71) Applicant: Michael Martin Uhl, Seattle, WA (US)

(72) Inventor: Michael Martin Uhl, Seattle, WA (US)

(73) Assignee: ELECTRIC MIRROR, LLC, Everett, WA (US)

( * ) Notice: Subject to any disclaimer, the term of this patent is extended or adjusted under 35 U.S.C. 154(b) by 0 days.

(21) Appl. No.: 13/958,618

(22) Filed: Aug. 5, 2013

(65) Prior Publication Data

US 2015/0036327 A1 Feb. 5, 2015

(51) Int. Cl.

| | |
|---|---|
| ***F21S 8/00*** | (2006.01) |
| ***A47G 1/02*** | (2006.01) |
| ***A45D 42/10*** | (2006.01) |
| ***A45D 42/16*** | (2006.01) |
| ***A47G 1/06*** | (2006.01) |

(52) U.S. Cl.

CPC *A47G 1/02* (2013.01); *A45D 42/10* (2013.01); *A45D 42/16* (2013.01); *A47G 1/0622* (2013.01); *F21S 8/033* (2013.01); *Y10T 29/49826* (2015.01)

(58) Field of Classification Search

CPC ..... F21S 8/033; A45D 42/16; A47G 1/0622

USPC ..... 362/140, 227, 235, 240, 243, 135

See application file for complete search history.

(56) References Cited

U.S. PATENT DOCUMENTS

| | | | | |
|---|---|---|---|---|
| 2,223,943 | A * | 12/1940 | Miller | 362/140 |
| 2,769,162 | A * | 10/1956 | O'Neill | 362/243 |
| 8,880,360 | B2 * | 11/2014 | Mischel et al. | 702/44 |
| 2007/0211452 | A1 * | 9/2007 | Gaunce et al. | 362/135 |

* cited by examiner

*Primary Examiner* — Anabel Ton

(74) *Attorney, Agent, or Firm* — Peloquin, PLLC; Mark S. Peloquin, Esq.

(57) ABSTRACT

An apparatus includes a first channel element; the first channel element has a first end and a second end and a length; and a first light element. The first light element has a length. A length of the first channel element is established using the length of the first light element. The first channel element further includes a coupleable area. The coupleable area permits the first channel element to be coupled to a second channel element, wherein the mirror chassis is formed thereby. A method to establish a set of channel element lengths for a mirror chassis includes selecting a set of light element lengths and then determining a channel element length from each light element length. The channel element length is selected to permit mounting a light element associated therewith.

36 Claims, 30 Drawing Sheets

MODULAR MIRROR CHASSIS APPARATUSES AND METHODS

BACKGROUND OF THE INVENTION

1. Field of Invention

The invention relates generally to mirror supporting structures, and more specifically to mirror chassis used for mirrors.

2. Art Background

Mirrors are used in a variety of locations, such as the bathroom, the kitchen, hallway, living room, etc. Lighting is sometimes incorporated into mirrors to facilitate their use. As such, lighting can be implemented in a direct or a non-direct fashion termed "back lighting" or a "backlit" mirror such that the user of the mirror does not have light shining directly in his or her eyes. Mirrors of these types can be used in commercial or residential settings, such as in hotels, public places, such as public bathrooms, public hall ways or walk ways or in the home.

Mirrors come in a variety of sizes in order to address all of the varied uses. Existing methods of designing a chassis for a mirror have started with a consideration of the mirror platform size. The design process then moves to setting dimensions, such as a length, for the channels that are used to make the chassis. Light elements are then incorporated into the chassis. Following this design methodology, a large number of parts results from making mirrors to suit a variety of uses. Just considering the design mirrors for the hotel industry, it is estimated that several thousand parts exist to make chassis for a variety of mirror platform sizes. Such an inventory of parts is expensive to make and maintain. Significant engineering and manufacturing resources are expended as well. This can present a problem.

Designing a mirror and its parts from the perspective of the mirror platform dimensions is also time consuming as well. Extra time spent on a design results in more expense and higher manufacturing costs. This can present a problem.

BRIEF DESCRIPTION OF THE DRAWINGS

The invention may best be understood by referring to the following description and accompanying drawings that are used to illustrate embodiments of the invention. The invention is illustrated by way of example in the embodiments and is not limited in the figures of the accompanying drawings, in which like references indicate similar elements.

DETAILED DESCRIPTION

In the following detailed description of embodiments of the invention, reference is made to the accompanying drawings in which like references indicate similar elements, and in which is shown by way of illustration, specific embodiments in which the invention may be practiced. These embodiments are described in sufficient detail to enable those of skill in the art to practice the invention. In other instances, well-known circuits, structures, and techniques have not been shown in detail in order not to obscure the understanding of this description. The following detailed description is, therefore, not to be taken in a limiting sense, and the scope of the invention is defined only by the appended claims.

Apparatuses and methods are described that permit a variety of chassis to be built for a variety of different size mirrors utilizing a minimum set of parts for the chassis. A methodology is described that bases a chassis element off of a length of a light element or a series of light elements. In various embodiments, construction of different sized chassis is done modularly with either a reduced set of parts or the same part used multiple times within a chassis. Elements in figures are shown either larger or smaller than actual size to facilitate clarity of illustration. No absolute or relative size information should be inferred therefrom.

Figure 1:
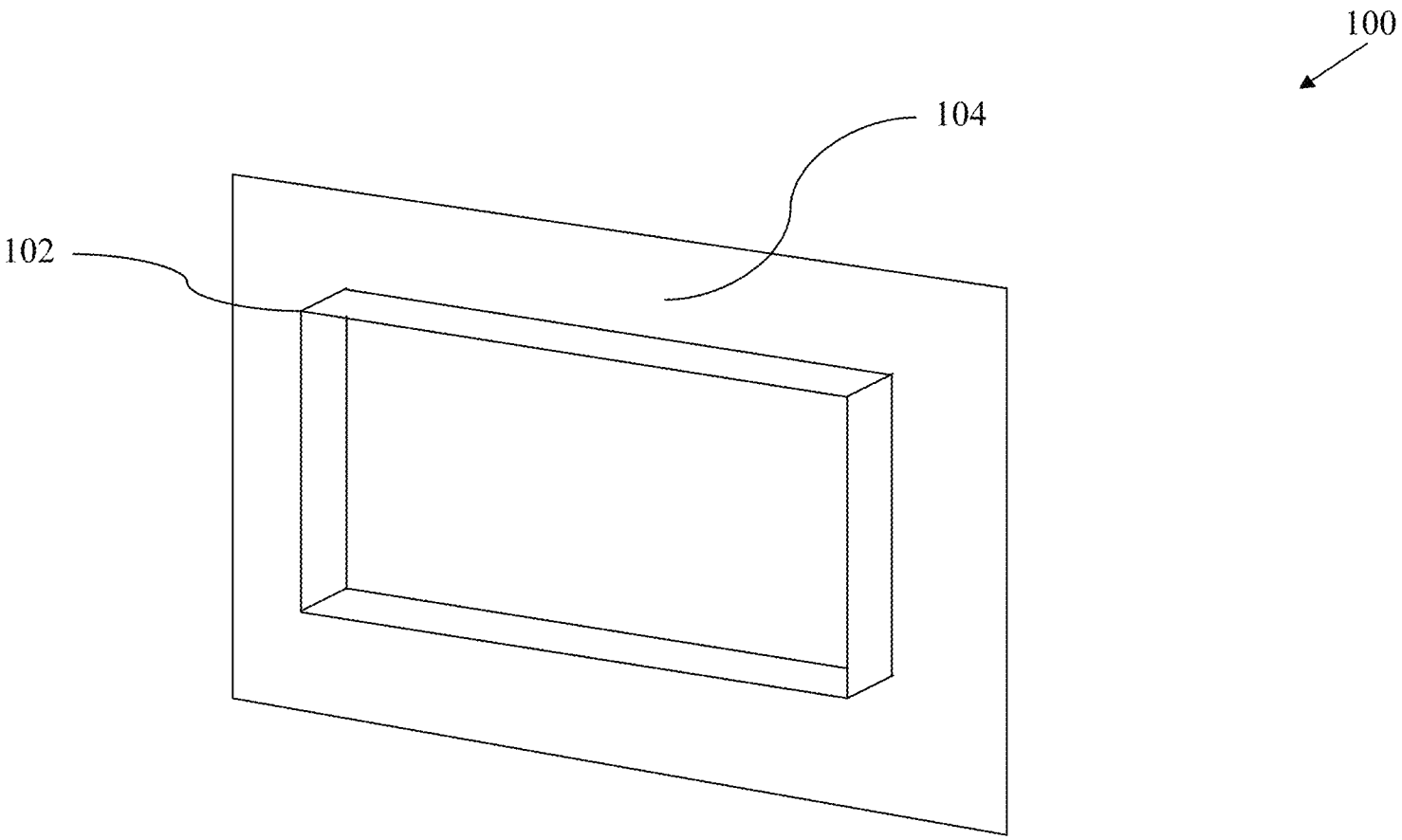
FIG. 1 illustrates an existing mirror chassis.

FIG. 1 illustrates, generally at 100, an existing mirror chassis. With reference to FIG. 1, an existing chassis for a mirror is shown in 100. Following a design methodology where the mirror platform sets the design parameters for a mirror, a chassis panel 104 is sized accordingly. Chassis partition 102 is mounted to the chassis panel 104. A number of light elements (not shown) are then fastened to either the chassis panel 104 or the chassis partition 102 to provide a source of backlight. Light is reflected from the chassis panel 104 to provide backlight through the mirror platform (not shown).

Figure 2A:
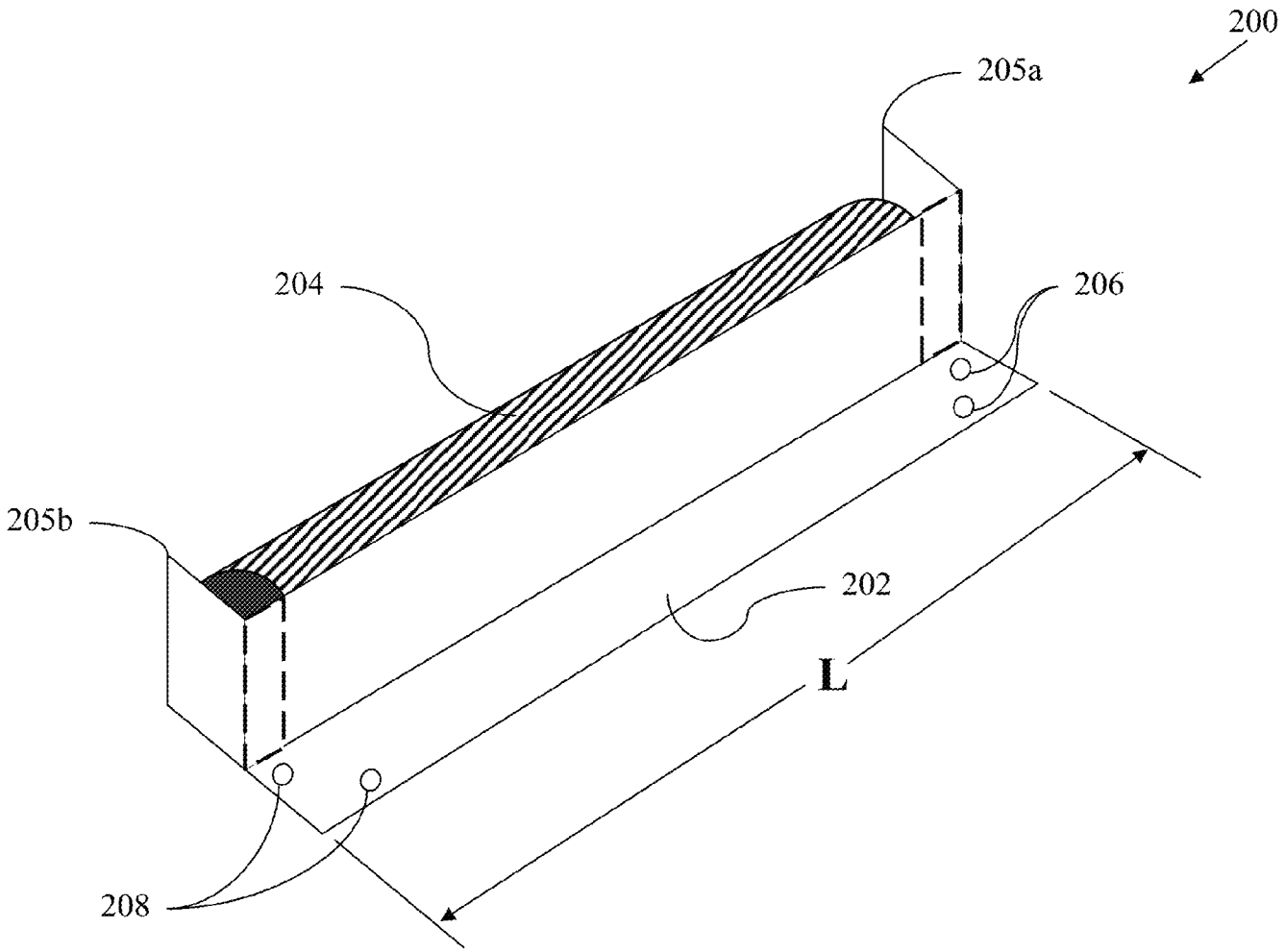
FIG. 2A illustrates a channel element assembly in perspective view, according to embodiments of the invention.

FIG. 2A illustrates, generally at 200, a channel element assembly in perspective view, according to embodiments of the invention. With reference to FIG. 2A, a channel element 202 has a light element 204 associated therewith. A mounting bracket 205*a* and a mounting bracket 205*b* are used in one embodiment to associate the light element 204 with the channel element 202.

A coupleable area is provided at each end of the channel element 202. At a first end of the channel element 202, a series of coupling holes is provided at 208. At a second end of the channel element 202, a series of holes is provided at 206. In various embodiments, more holes are provided and in some embodiments less holes are provided at a coupling area. In some embodiments, there will be only one hole in a coupling area. In yet other embodiments, more than two holes will be provided. In some embodiments, a symmetric pattern (symmetric about mutually perpendicular axes) of coupling holes will be provided such that two channel elements can be coupled together either in a parallel fashion or a perpendicular fashion (as described below in the figures that follow).

Coupling areas can be provided with various structural elements for coupling such as holes or slots. In yet other embodiments, coupling is done by welding channel elements together in the coupling area. Fasteners (not shown) are used with the coupling areas to accomplish coupling. A list of fasteners includes, but is not limited to, a rivet, a pin, a wire, a screw, a bolt, a snap, and a weld. In some embodiments, channel elements snap together with mechanical snaps located in the coupling areas.

According to the teachings presented herein, a length of the light element 204 is used to size a length of the channel element 202. For example, the light element 204 is selected based on its length and suitability for a given design of a mirror. The channel element is then sized to accommodate associating the light element therewith. In some embodiments, a length of the channel element 202 is equal to a length of the light element 204. In other embodiments, a length of the channel element 202 is less than a length of the light element 204. In yet other embodiments, a length of the channel element 202 is greater than a length of the light element 204.

In various embodiments, a channel element can be made from a variety of materials such for example, metal, plastic wood, etc. In some embodiments, channel elements are made from aluminum, stainless steel, steel, galvanized steel, painted metal, copper, etc. In yet other embodiments, channel elements are made via an extrusion process and are then cut to length with consideration given to a length that is determined by the light element that will be associated therewith.

In some embodiments, a channel element contains fasteners or coupling areas that permit accessory elements to be attached thereto or activated. For example, in some embodiments, an accessory feature is a knockout panel or hole. The knockout panel or hole permits light to pass through and provide a soft aura of light at a portion of the perimeter of the mirror. An example of such an accessory is illustrated below in conjunction with FIG. 8B and FIG. 8C. In yet other embodiments, an accessory feature is a mount for speaker, a mount for a television panel or component, a mount for an electrical component such as for example a ballast, a mount for a switch, etc.

Figure 2B:
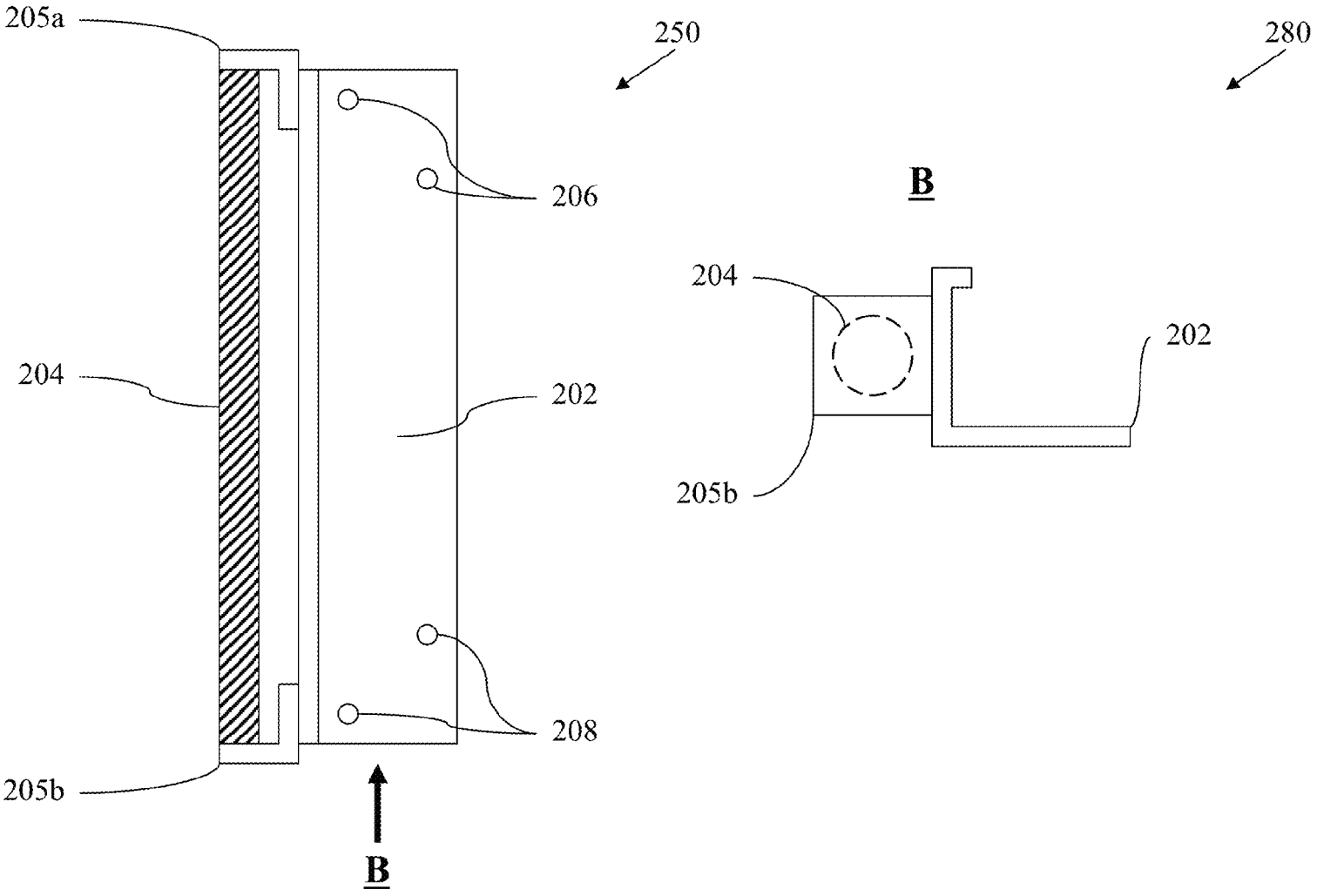
FIG. 2B illustrates a top and end view of the channel element of FIG. 2A, according to embodiments of the invention.

FIG. 2B illustrates a top and end view of the channel element of FIG. 2A, according to embodiments of the invention. With reference to FIG. 21, a top view of the channel element is illustrated at 250. An end view of the channel element, indicated by direction arrow B, is illustrated at 280.

Figure 3:
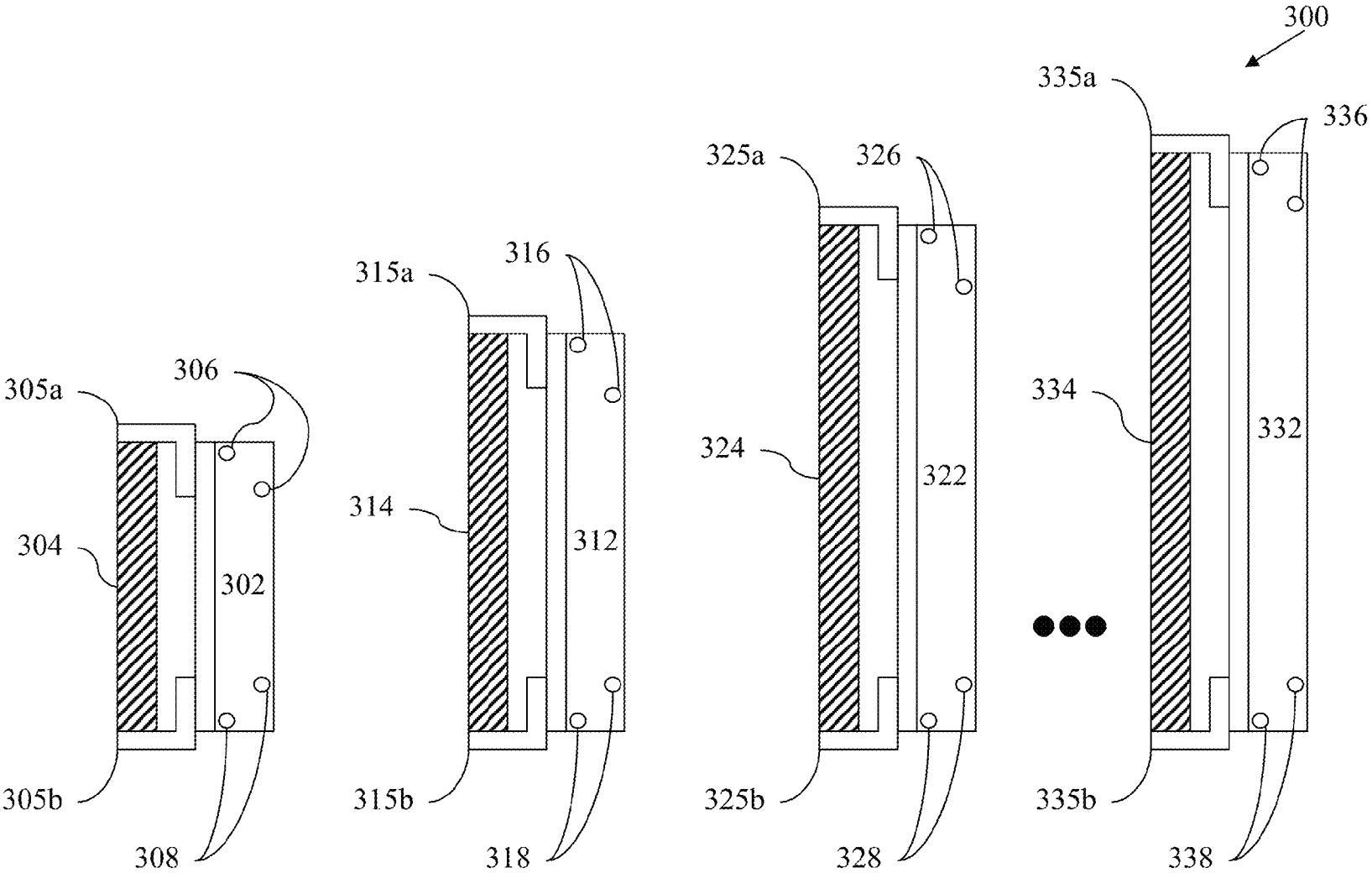
FIG. 3 illustrates a plurality of channel elements, according to embodiments of the invention.

FIG. 3 illustrates, generally at 300, a plurality of channel elements, according to embodiments of the invention. With reference to FIG. 3, a set or equivalently a plurality of channel elements is shown. The plurality can have any number of channel elements ranging from one to a general number n. As described above, lengths of the channel elements 302, 312, 322, and 332 are derived from the lengths of light elements 304, 314, 324, and 334. Thus, the lengths of the light elements establish the lengths of the channel elements.

The light element 304 is associated with the channel element 302 using a bracket 305*a* and 305*b*. Two coupling areas are shown on the channel element 302, a first coupling area contains holes 308 and a second coupling area contains holes 306. The light element 314 is associated with the channel element 312 using a bracket 315*a* and 315*b*. Two coupling areas are shown on the channel element 312, a first coupling area contains holes 318 and a second coupling area contains holes 316. The light element 324 is associated with the channel element 322 using a bracket 325*a* and 325*b*. Two coupling areas are shown on the channel element 322, a first coupling area contains holes 328 and a second coupling area contains holes 326. The light element 334 is associated with the channel element 332 using a bracket 335*a* and 335*b*. Two coupling areas are shown on the channel element 332, a first coupling area contains holes 338 and a second coupling area contains holes 336.

Note that a channel element can be constructed for each light element length. Alternatively, according to embodiments of the invention, the series of channel element assemblies shown in FIG. 3 can be accomplished with two channel elements having different lengths. In such a case, two channel elements are coupled together using coupling areas at their respective ends thereby forming a channel element having a length that is longer than either of the channel elements individually. If the light elements are graduated in size by approximately a uniform change in length then each light element can be accommodated by adding a successive channel element, thereby extending the resulting assembly from two to three or from three to four channel elements as needed to provide a combined length sufficient to accommodate the various lengths of light elements.

Figure 4A:
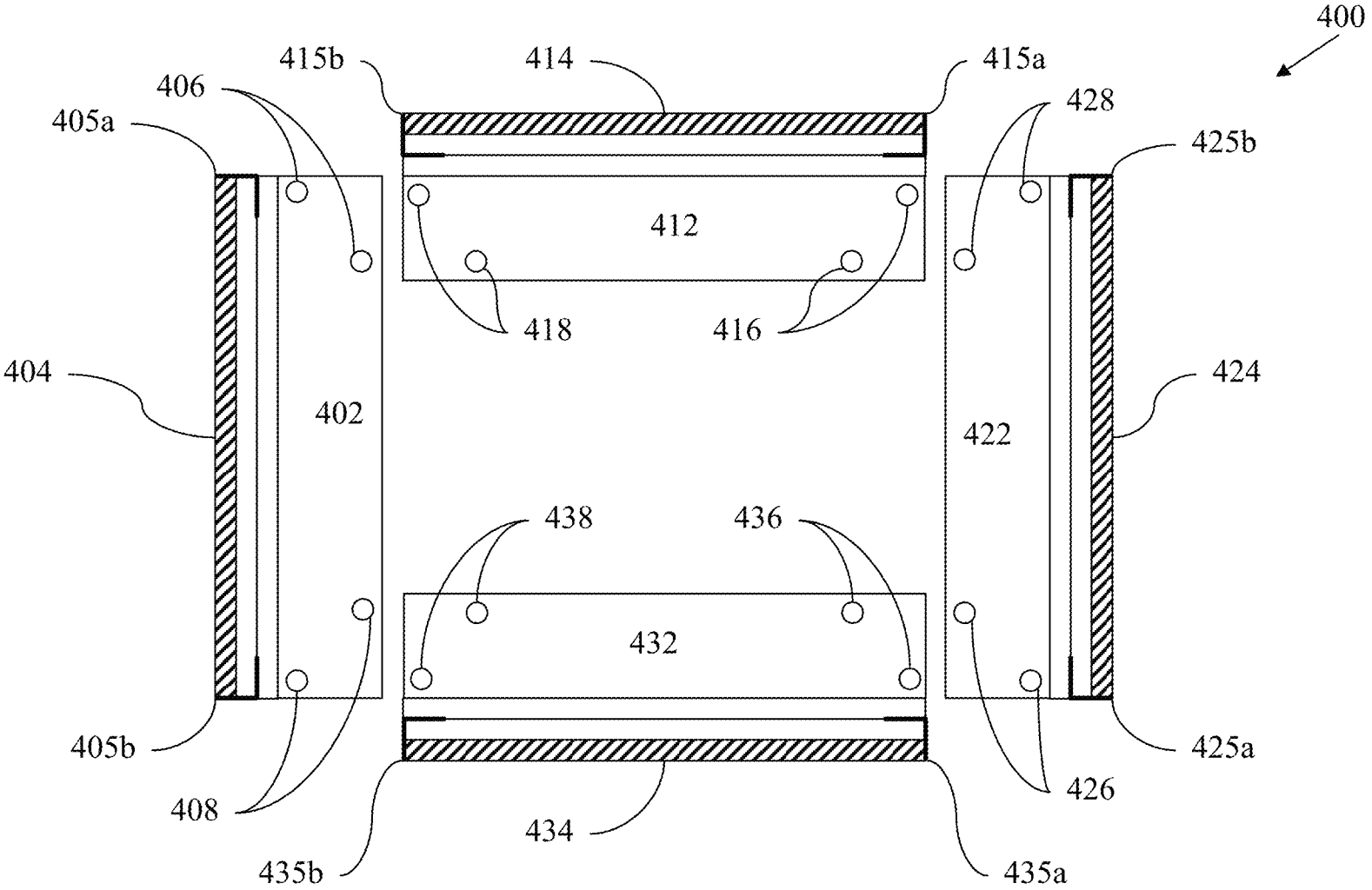
FIG. 4A illustrates an exploded view of channel elements used in a mirror chassis, according to embodiments of the invention.

FIG. 4A illustrates, generally at 400, an exploded view of channel elements used in a mirror chassis, according to embodiments of the invention. With reference to FIG. 4A, four channel elements are shown. A first channel element 402 has associated therewith a light element 404. The first channel element 402 has holes for providing coupling at 408 and 406. The light element 404 is associated with the channel element 402 using a bracket 405*a* and a bracket 405*b*. A second channel element 412 has associated therewith a light element 414. The second channel element 412 has holes for providing coupling at 418 and 416. The light element 404 is associated with the channel element 412 using a bracket 415*a* and a bracket 415*b*. A third channel element 422 has associated therewith a light element 424. The third channel element 422 has holes for providing coupling at 428 and 426. The light element 424 is associated with the channel element 422 using a bracket 425*a* and a bracket 425*b*. A fourth channel element 432 has associated therewith a light element 434. The fourth channel element 432 has holes for providing coupling at 438 and 436. The light element 434 is associated with the channel element 432 using a bracket 435*a* and a bracket 435*b*.

Figure 4B:
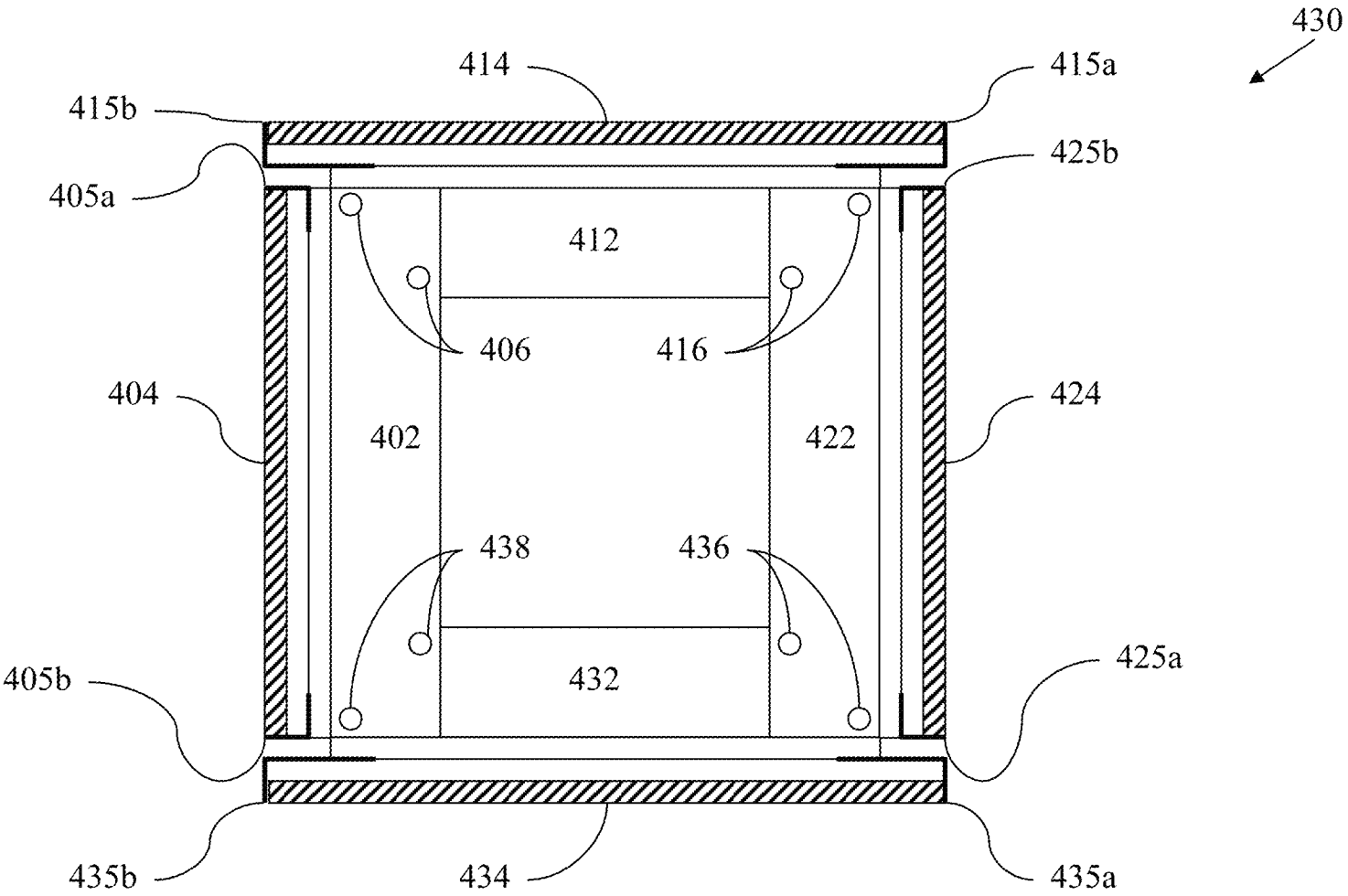
FIG. 4B illustrates an assembled view of the channel elements from FIG. 4A, according to embodiments of the invention.

FIG. 4B illustrates, generally at 430, an assembled view of the channel elements from FIG. 4A, according to embodiments of the invention. With reference to FIG. 4B, the channel elements are coupled together utilizing the aforementioned holes for coupling. A variety of fasteners can be used in the coupling, such as but not limited to, a rivet, a pin, a wire, a screw, a bolt, a weld, etc. Note that when some fasteners are used holes are not needed. Whenever holes are used in any of the figures, they are used merely for illustration and are not limiting in any way.

Note that in FIG. 4B, the light elements 414 and 434 have a length that exceeds their respective channel elements, i.e., 412 and 432. The light elements 404 and 424 have a length that is approximately equal to a length of their respective channel elements 402 and 422. In various embodiments, a light element will have a length that can be different from a length of a channel element to which it is associated; however the length of the channel element is determined by considering the light element which will be associated therewith.

Figure 4C:
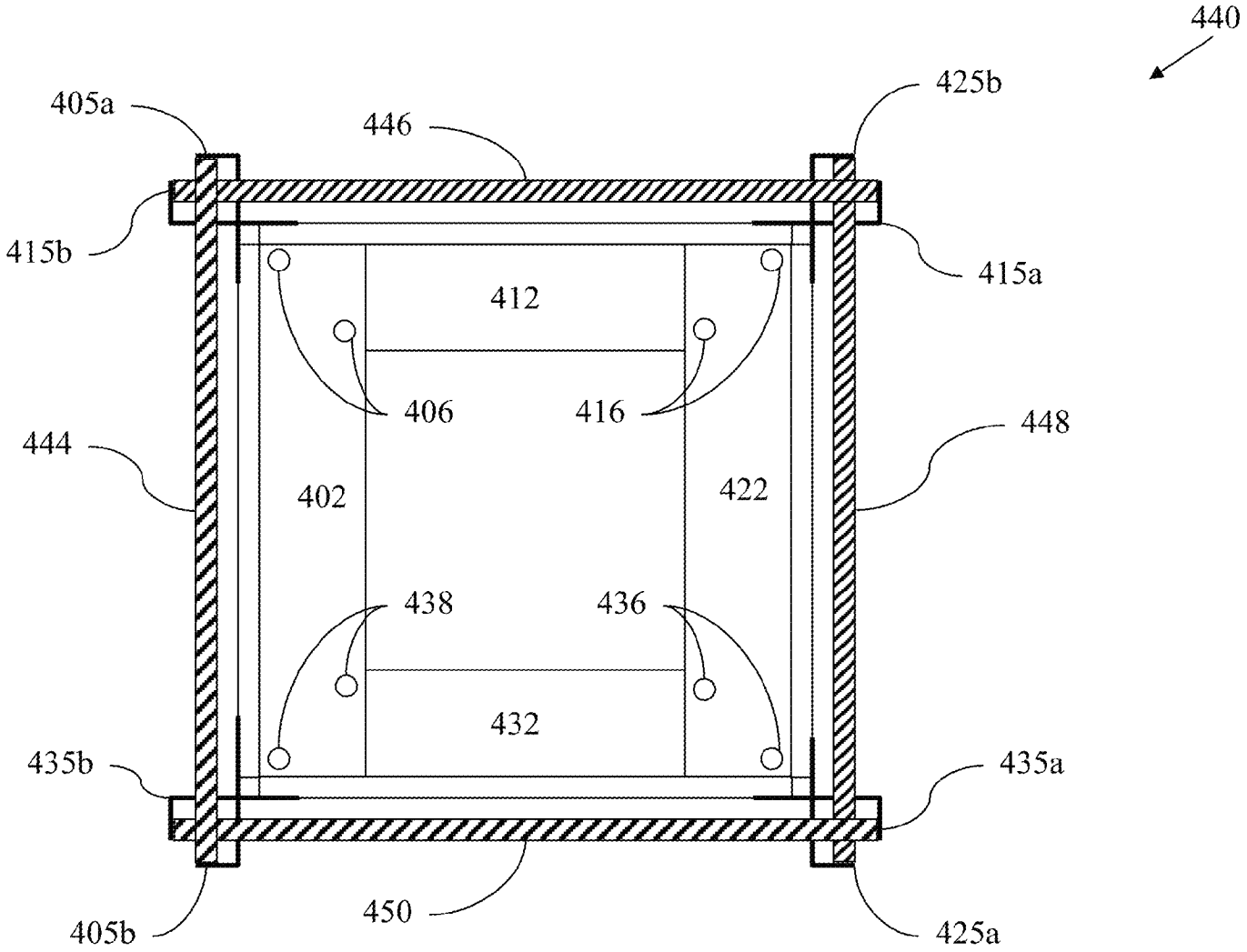
FIG. 4C illustrates an assembled view of the channel elements from FIG. 4A with different light elements, according to embodiments of the invention.

FIG. 4C illustrates, generally at 440, an assembled view of the channel elements from FIG. 4A with different light elements, according to embodiments of the invention. With reference to FIG. 4C, a light element 444 is associated with the channel element 402. A length of the light element 444 is greater than a length of the channel element 402 with which it is associated. A length of the light element 446 is greater than a length of the channel element 412 with which it is associated. A length of the light element 448 is greater than a length of the channel element 422 with which it is associated. Similarly, a length of the light element 450 is greater than a length of the channel element 432 with which it is associated.

Figure 4D:
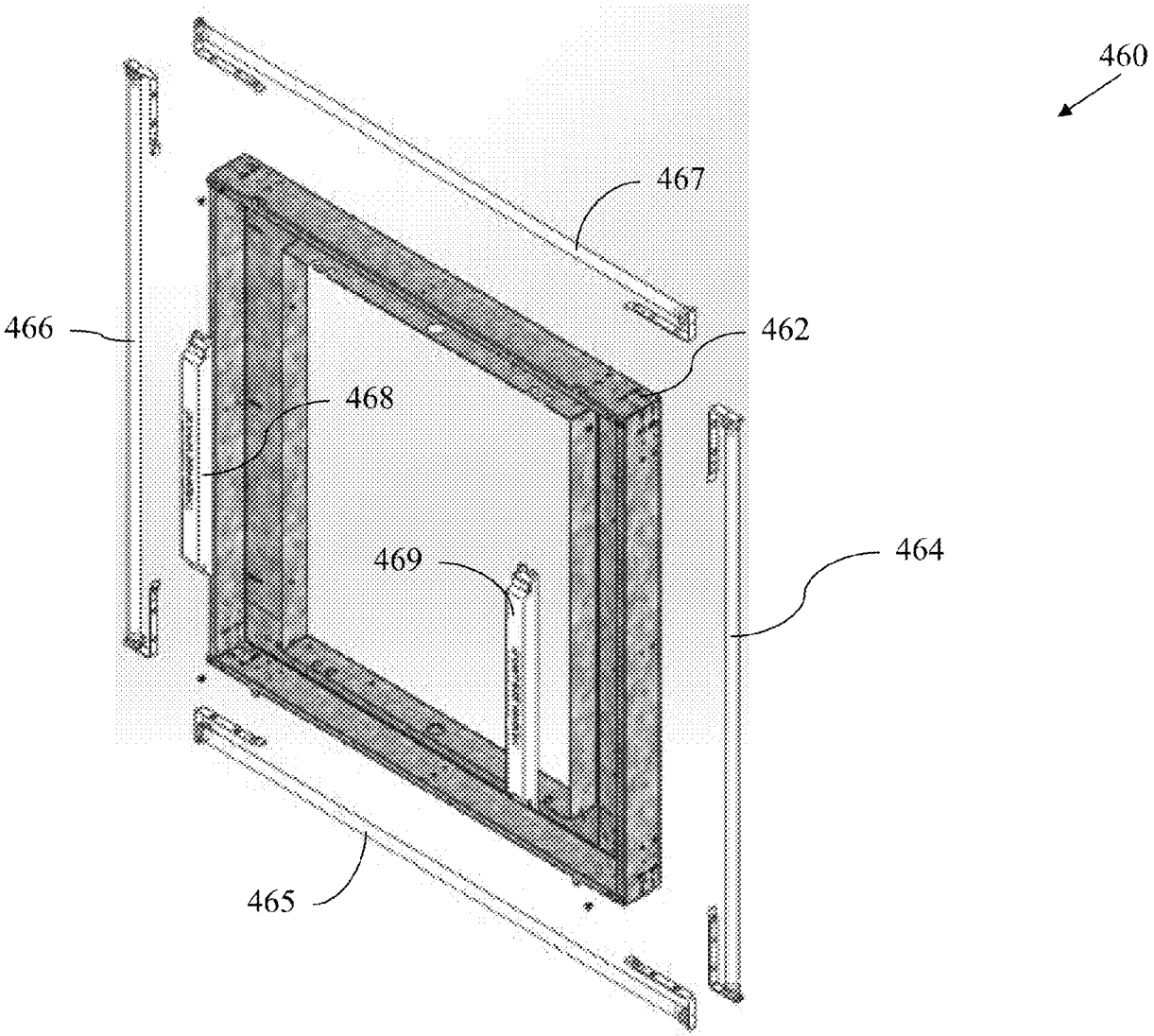
FIG. 4D illustrates a computer rendered exploded view of the channel elements according to additional embodiments of the invention.

FIG. 4D illustrates, generally at 460, a computer rendered exploded view of the light elements according to additional embodiments of the invention. With reference to FIG. 4D, a chassis for a mirror is shown at 462 with light element 464, 465, 466, and 467. Optional ballasts 468 and 469 are shown, which will mount within the vertical channel elements (see FIG. 4E). Note that optional ballasts 468 and 469 can also be mounted in the horizontal channel elements of the chassis 462.

Figure 4E:
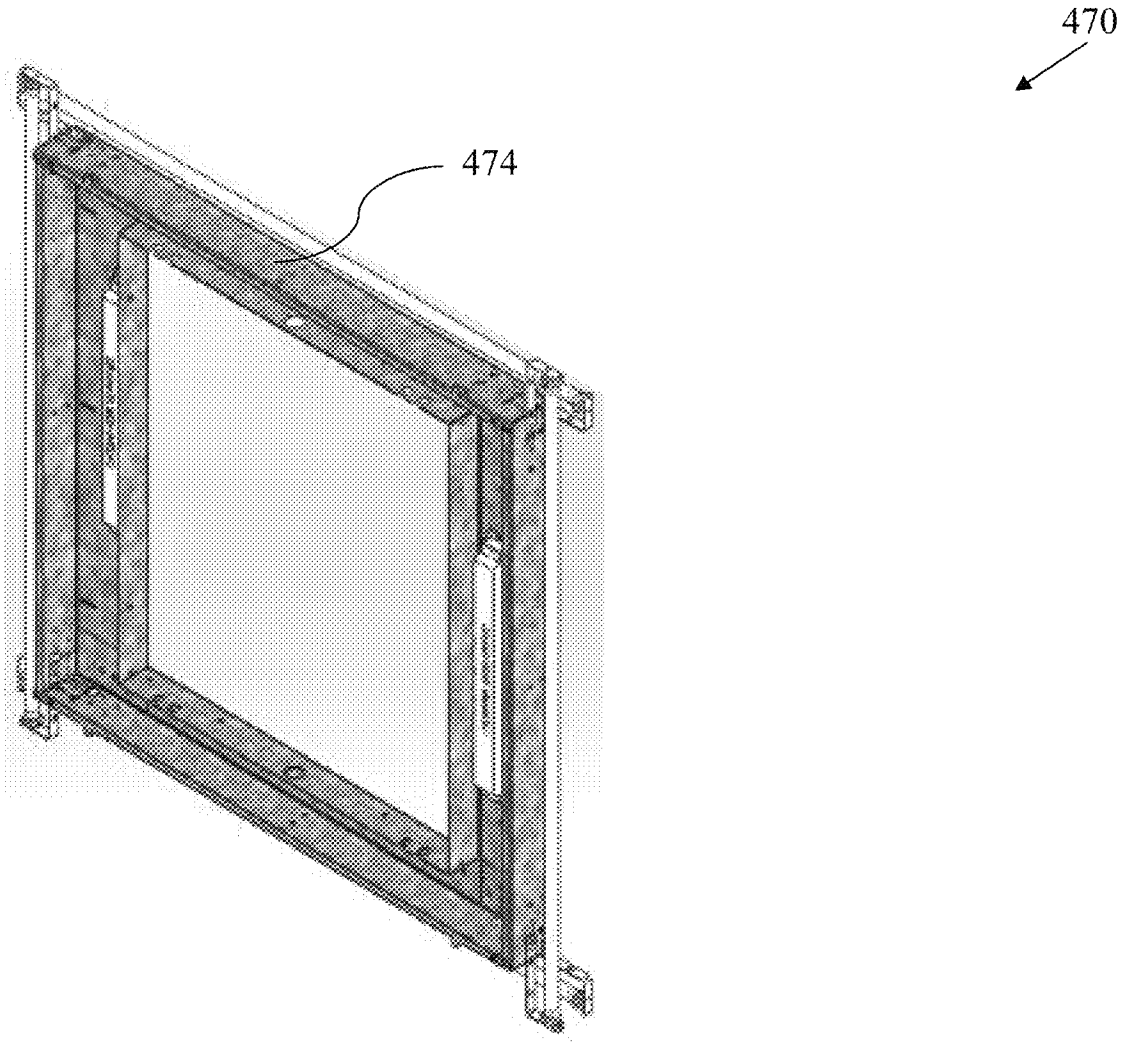
FIG. 4E illustrates a computer rendered assembled view of the channel elements from FIG. 4D according to embodiments of the invention.

FIG. 4E illustrates, generally at 470, an assembled view of the channel elements from FIG. 4D according to embodiments of the invention.

Figure 4F:
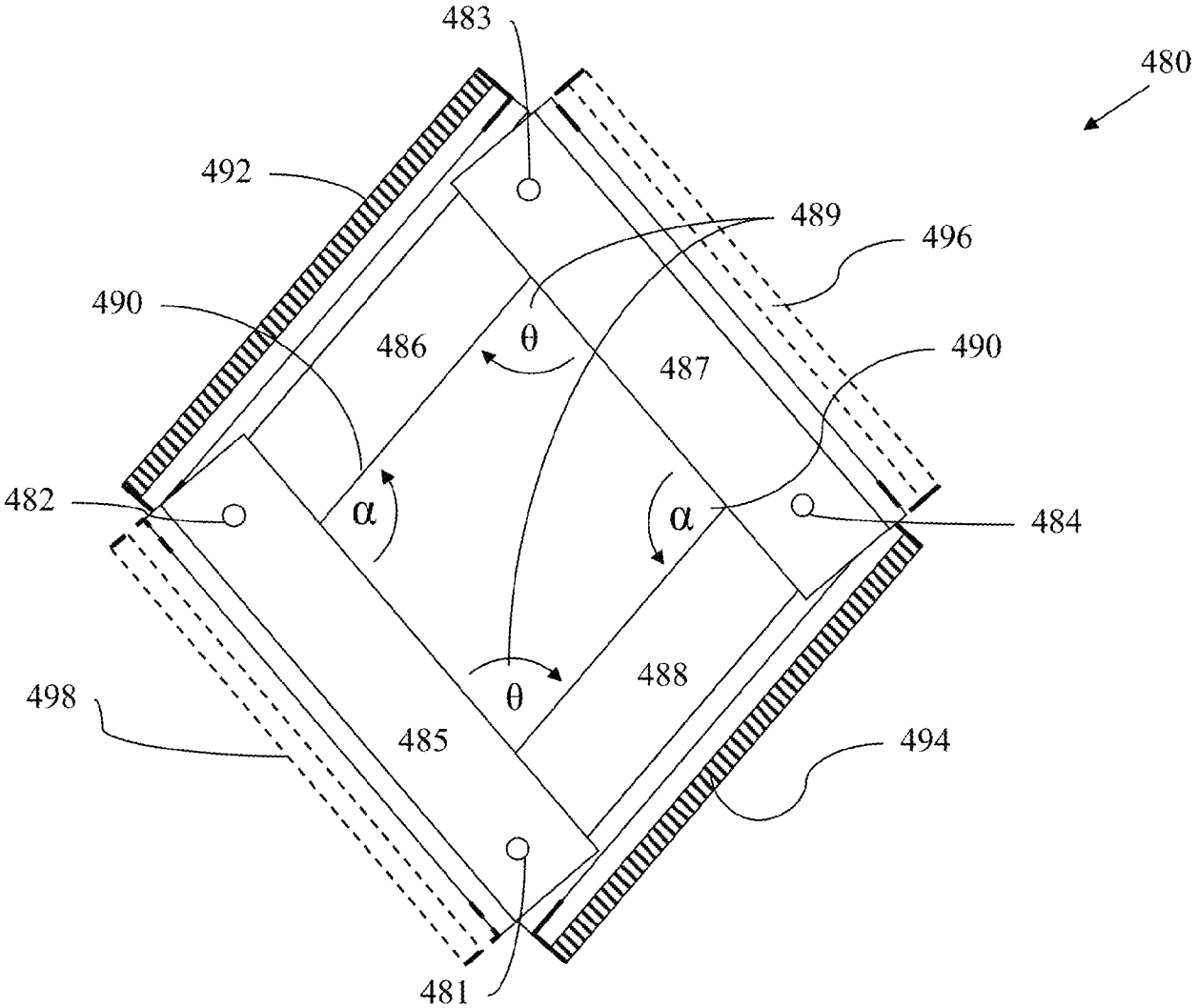
FIG. 4F illustrates an assembled view of channel elements which form a diamond shape, according to embodiments of the invention.

FIG. 4F illustrates, generally at 480, an assembled view of channel elements which form a diamond shape, according to embodiments of the invention. With reference to FIG. 4F, a channel element 486 and 487 form an angle θ 489 there between. Similarly, a channel element 485 and 488 form an angle θ 489 there between. Angle θ 489 can depart from ninety degrees. The channel element 486 and the channel element 485 form an angle α 490 there between. Similarly, the channel element 487 and the channel element 488 form an angle α 490 there between. The channel elements 485, 486, 487, and 488 are manipulated to vary the angles α 490 and θ 489 in order to accommodate different mirror geometries. In one embodiment, the channel elements are manipulated when the channel elements rotate at locations 481, 482, 483, and 484. In one embodiment, once the desired orientation is obtained with channel elements 485, 486, 487, and 488, the channel elements can be secured into place with fasteners at 481, 482, 483, and 484.

Channel elements 485, 486, 487, and 488 extend both horizontally and vertically, thus when configured as shown in FIG. 4F, designations of vertical and horizontal do not provide distinguishing information with regard to a channel element.

Figure 5A:
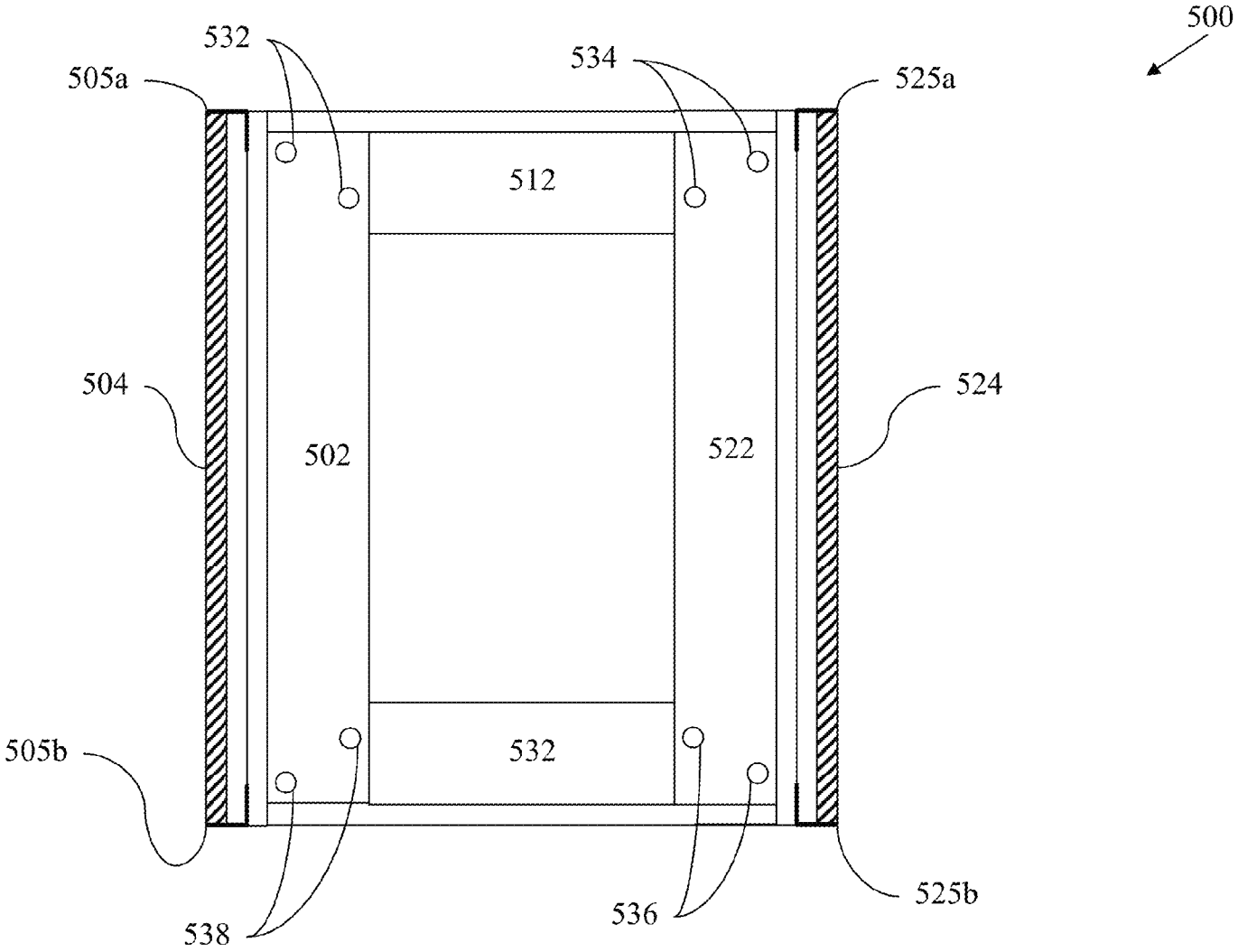
FIG. 5A illustrates using light elements in vertical channel elements of a chassis for a mirror, according to embodiments of the invention.

FIG. 5A illustrates, generally at 500, using light elements in vertical channel elements of a chassis for a mirror, according to embodiments of the invention. With reference to FIG. 5A, a channel element, such as 502 and 522, oriented in a vertical fashion can be referred to as vertical channel elements. Likewise, channel elements 512 and 532, oriented horizontally, can be referred to as horizontal channel elements. Terms such as vertical and horizontal draw meaning from an orientation of a mirror when hung on a wall for example.

A light element 504 is associated with the channel element 502 and is coupled thereto with a bracket 505*b* and a bracket 505*a*. A light element 524 is associated with the channel element 522 and is coupled thereto with a bracket 525*a* and a bracket 525*b*. The channel elements 502, 512, 522, and 532 have coupling areas at each of their respective ends. Each of the coupling areas has an attachment pattern and in one embodiment, utilizes a series of holes in the attachment pattern indicated by 532, 534, 536, and 538. At 532 the attachment patterns from channel elements 502 and 512 overlap thus permitting fasteners to be used to secure 502 and 512 together. At 534 the attachment patterns from channel elements 512 and 522 overlap thus permitting fasteners to be used to secure 512 and 522 together. At 536 the attachment patterns from channel elements 522 and 532 overlap thus permitting fasteners to be used to secure 522 and 532 together. Similarly, at 538 the attachment patterns from channel elements 532 and 502 overlap thus permitting fasteners to be used to secure 532 and 502 together.

Figure 5B:
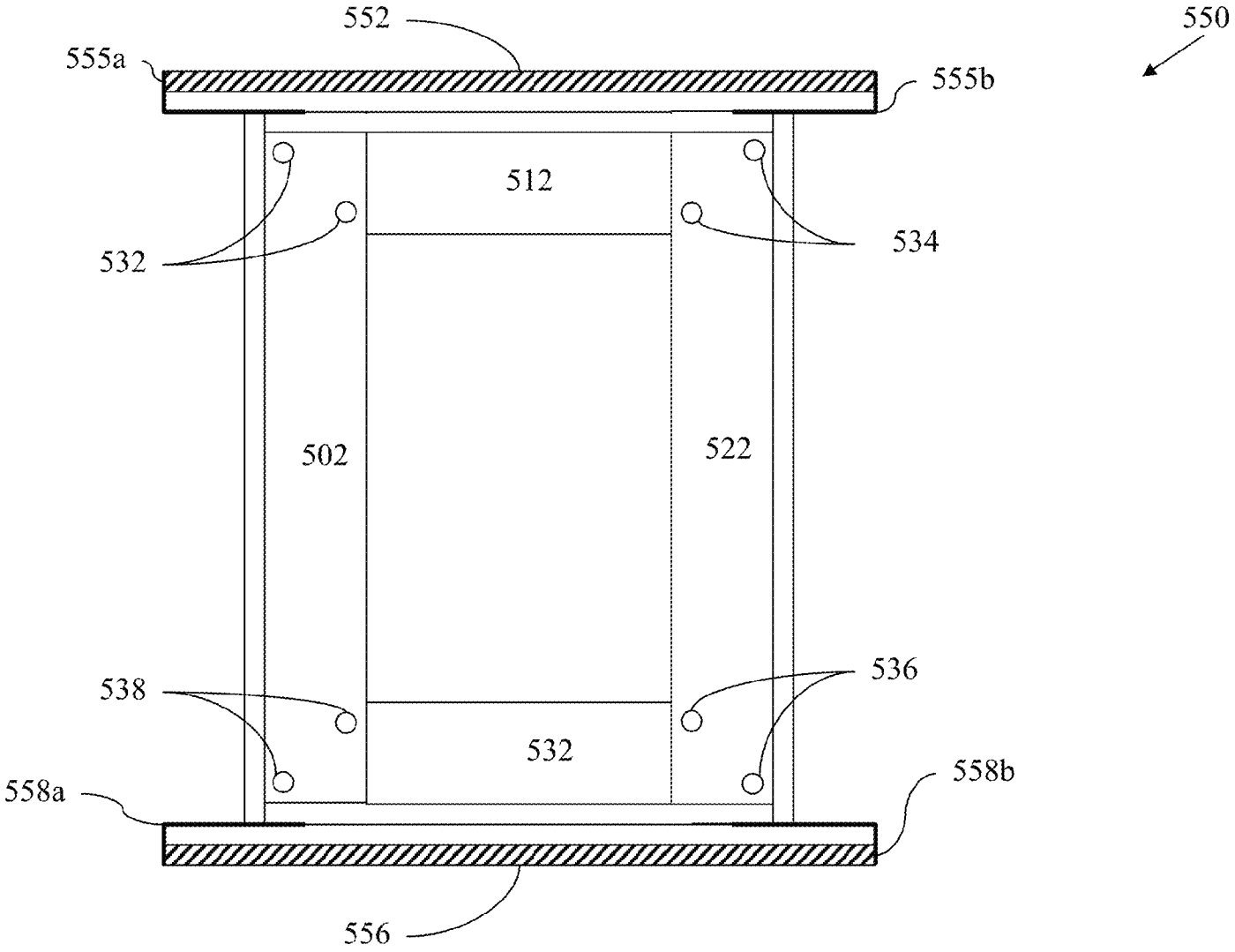
FIG. 5B illustrates another configuration of a chassis for a mirror, according to embodiments of the invention.

FIG. 5B illustrates, generally at 550, another configuration of a chassis for a mirror, according to embodiments of the invention. With reference to FIG. 5B, light elements 504 and 524 (FIG. 5A) are not provided. Instead, a light element 552 is associated with the channel element 512 using a bracket 555*a* and a bracket 555*b*. A light element 556 is associated with channel element 532 using a bracket 558*a* and 558*b*. Light elements 552 and 556 are referred to as horizontal light elements when the mirror chassis is oriented on a wall with "up" corresponding to the top of FIG. 5B and "down" corresponding to the bottom of FIG. 5B.

In the embodiments illustrated in FIG. 5B, the relative length of the light elements 552 and 556 is greater than the corresponding channel elements that they are associated with, i.e., 512 and 532. In FIG. 5A, the length of the light elements 504 and 524 is approximately equivalent to the length of the channel elements that they are associated with, i.e., 502 and 522. The relative lengths of light elements and channel element length shown in FIG. 5A and FIG. 5B are provided merely for example. There is no restriction placed on relative lengths of light element length and corresponding channel element length by use in the horizontal or vertical orientations.

In some embodiments, light elements having different lengths are used in a chassis for a mirror following the teachings herein. In such embodiments, a channel element is still sized to accommodate the particular light element that it is associated with.

Figure 6A:
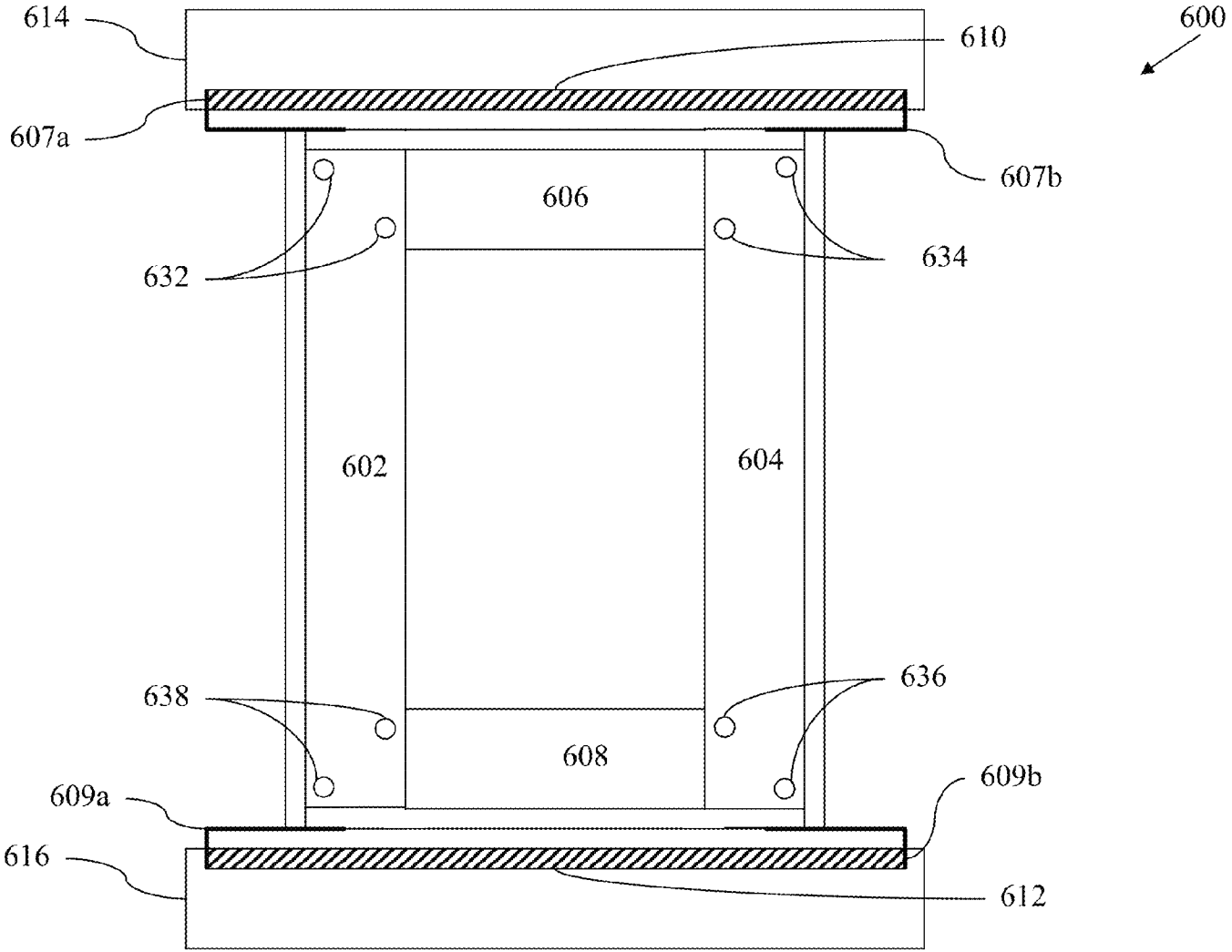
FIG. 6A illustrates using light wings in a chassis for a mirror, according to embodiments of the invention.

FIG. 6A illustrates, generally at 600, using light wings in a chassis for a mirror, according to embodiments of the invention. With reference to FIG. 6A, the chassis for the mirror is shown with channel elements 602, 604, 606, and 608 coupled together. In the present illustration, channel elements are coupled together by welding channel elements together in the coupling areas. Alternatively, in other embodiments, attachment patterns can be provided as previously described as indicated by 632, 634, 636, and 638.

A light element 610 is associated with the channel element 606 utilizing brackets 607*a* and 607*b*. A light element 612 is associated with the channel element 608 utilizing mounting brackets 609*a* and 609*b*. Light radiated from the light elements is reflected off of the light wings 614 and 616 and provides a source of light illumination for a mirror platform (not shown to preserve clarity of the illustration) that is mounted on the chassis of FIG. 6A.

In various embodiments, a light wing is made from a variety of materials such as for example, metal, plastic wood, composite, etc. In some embodiments, light wings are made from aluminum, stainless steel, steel, galvanized steel, painted metal, copper, etc. In yet other embodiments, light wings are made via an extrusion process and are then cut to length with consideration given to a length that is determined by the light element that will be associated therewith.

In some embodiments, light wings can be made from a translucent material which acts as a diffuser thereby allowing some light to pass through which provides perimeter illumination around the mirror platform. In yet other embodiments, a light wing is made from a translucent material, which acts as a diffuser with the addition of one or more holes which permits some light to pass through. Such a configuration provides a different level of illumination around the perimeter of the mirror platform.

Figure 6B:
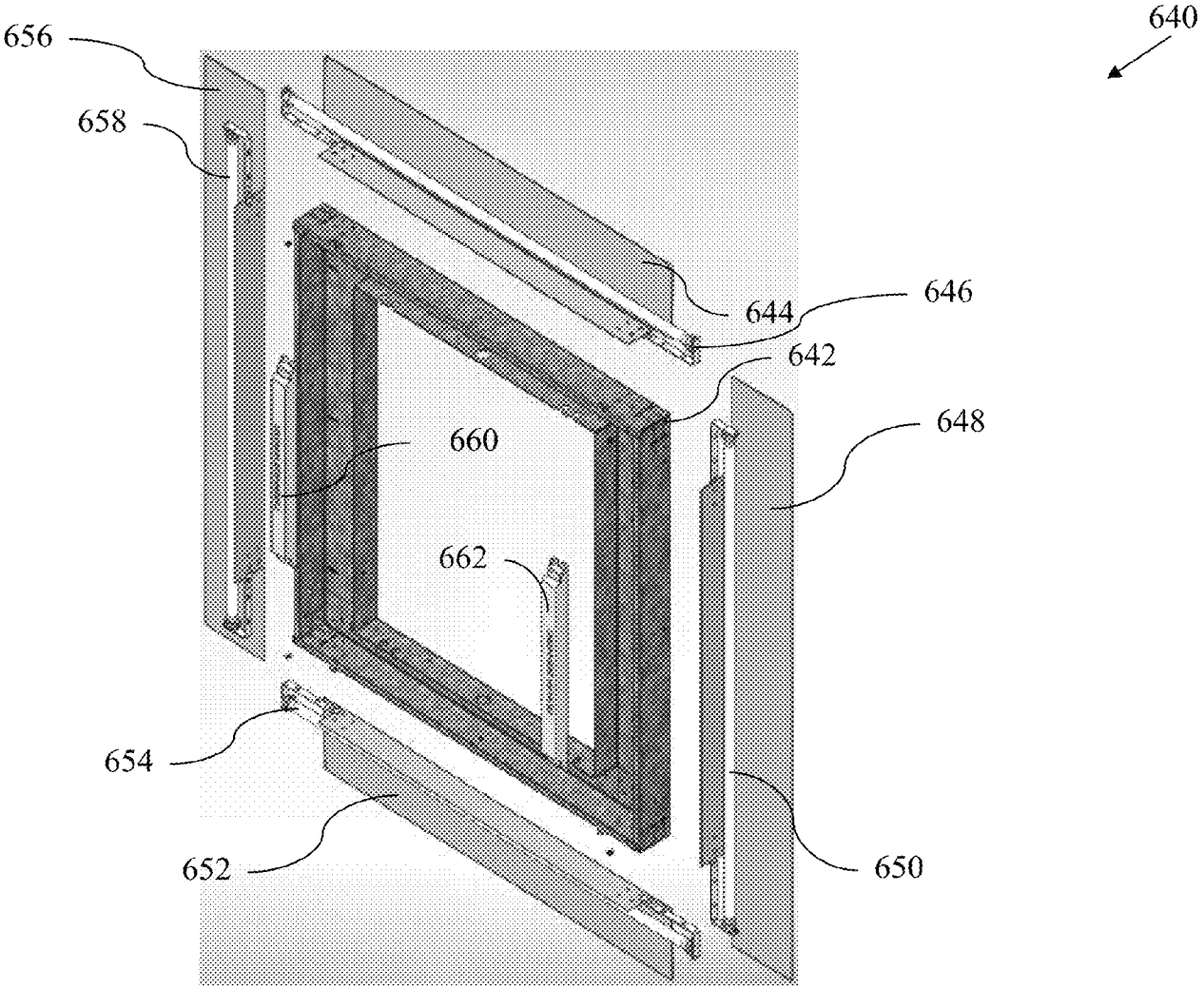
FIG. 6B illustrates a computer rendered exploded view of the light elements and light wings according to additional embodiments of the invention.

FIG. 6B illustrates, generally at 640, a computer rendered exploded view of light elements and light wings according to additional embodiments of the invention. With reference to FIG. 6B, a mirror chassis made from channel elements is shown at 642. Optional ballasts 660 and 662 can be mounted to the chassis 642. A first light element 646 and a first light wing 644 are shown in exploded view relative to the chassis 642. Similarly, a second light element 650 and a second light wing 648 are shown in exploded view relative the chassis 642. A third light element 654 and a third light wing 652 are shown in exploded view relative to the chassis 642. And a fourth light element 658 and a fourth light wing 656 are shown in exploded view relative to the chassis 642.

Figure 6C:
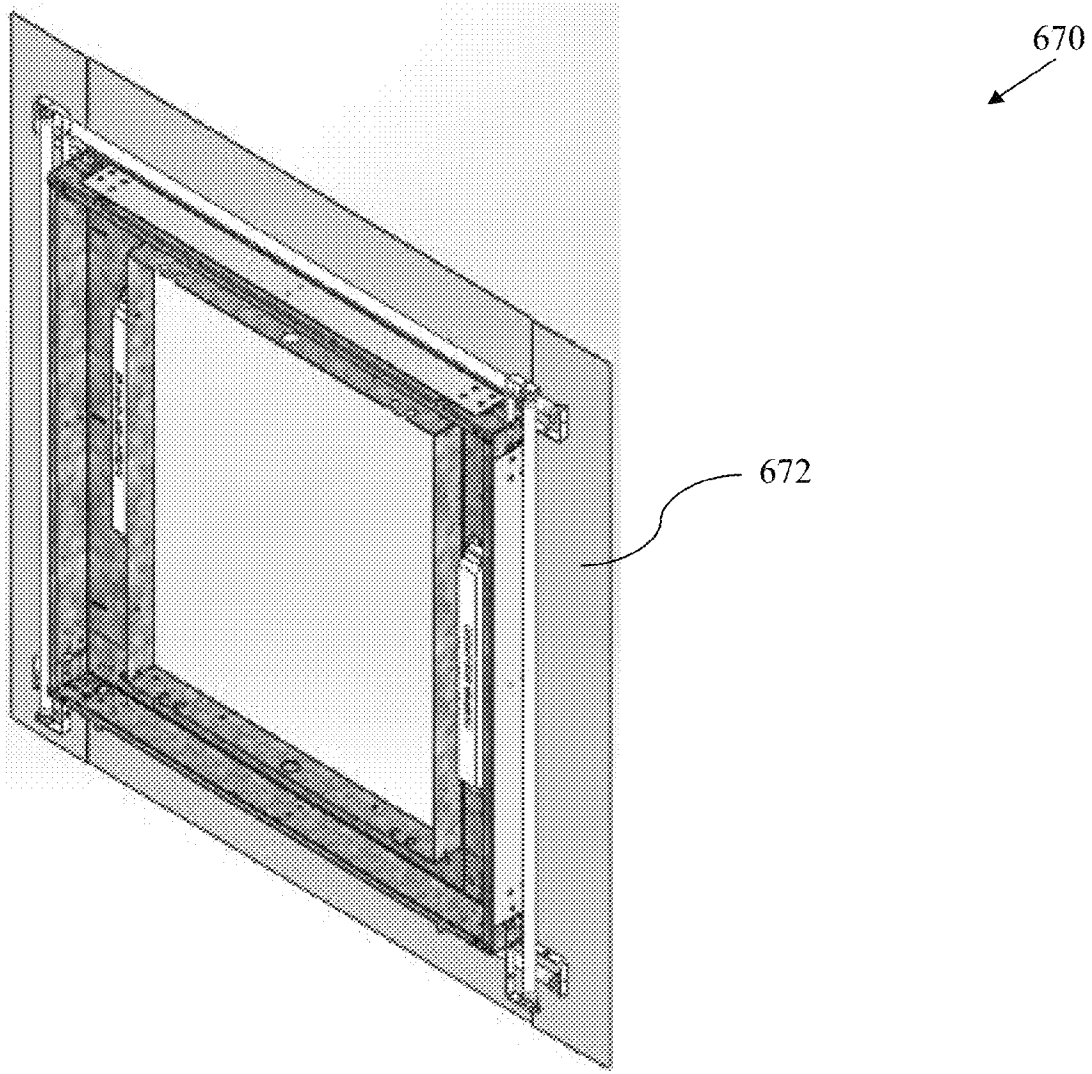
FIG. 6C illustrates a computer rendered assembled view of the channel elements from FIG. 6B according to embodiments of the invention.

FIG. 6C illustrates, generally at 670, a computer rendered assembled view of the channel elements from FIG. 6B according to embodiments of the invention. With reference to FIG. 6C, an assembled chassis 672 contains all of the components shown in FIG. 6C in exploded view.

Figure 6D:
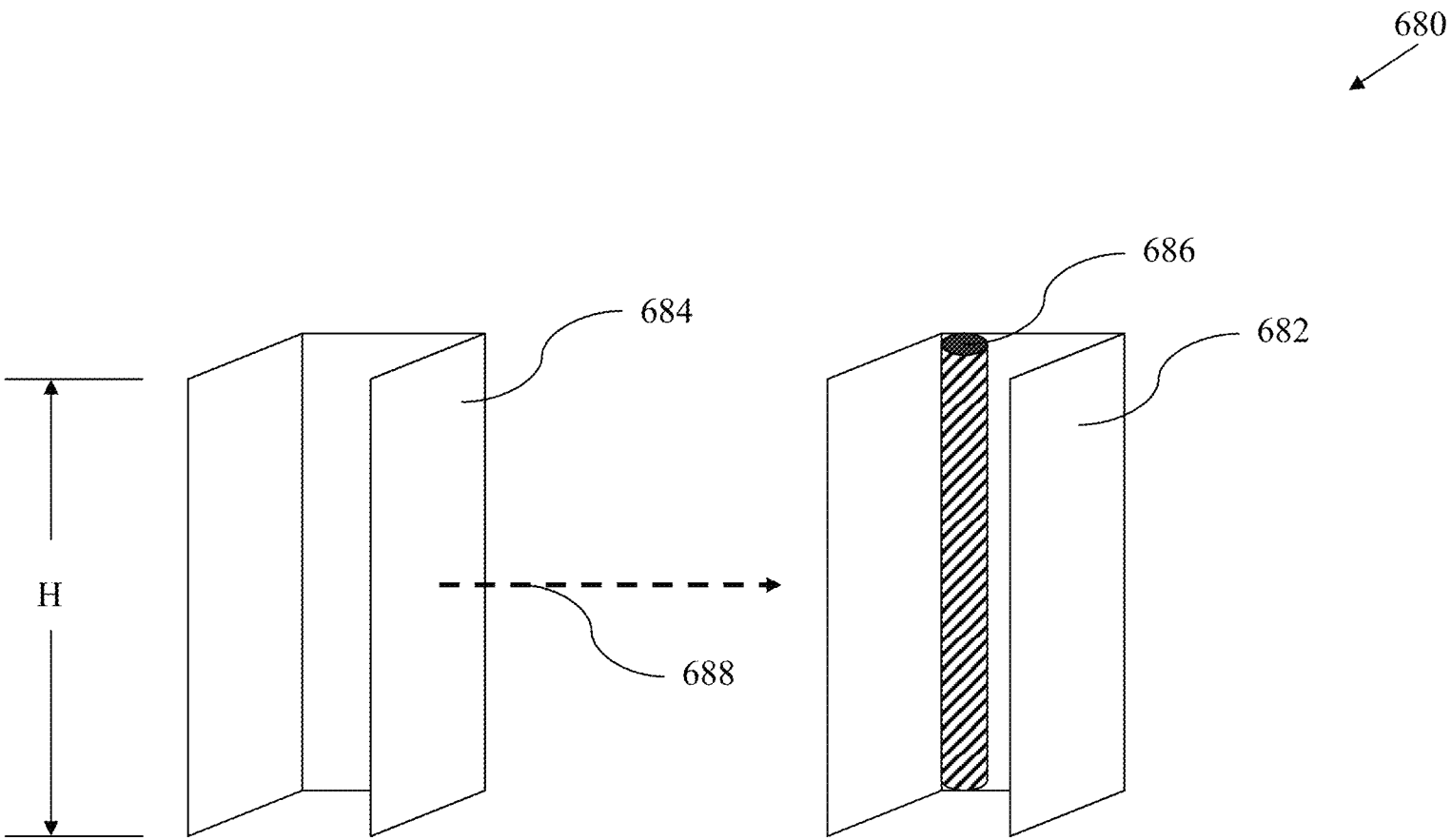
FIG. 6D illustrates a light wing according to according to other embodiments of the invention.

FIG. 6D illustrates, generally at 680, a light wing according to other embodiments of the invention. With reference to FIG. 6D, a light wing can be fashioned into a variety of different shapes, for use in different embodiments of the invention. For example, a light wing 682 is fashioned into a channel shape. A channel element 684 of a chassis can be similar in cross-section to the cross-section of the light wing 682.

A light element 686 is mounted within the channel formed by the light wing 682 Note that only a portion H of the channel element 684 and corresponding light wing 682 are shown in FIG. 6D. The channel 684 and the light wing 682 can extend to various lengths as needed for During assembly, the chassis element 684 is coupled to the light wing 682 and the light element 686 as indicated by an assembly arrow 688. Such assembly contributes to an assembled view which is similar to other assembled views shown in this description of embodiments.

Figure 7A:
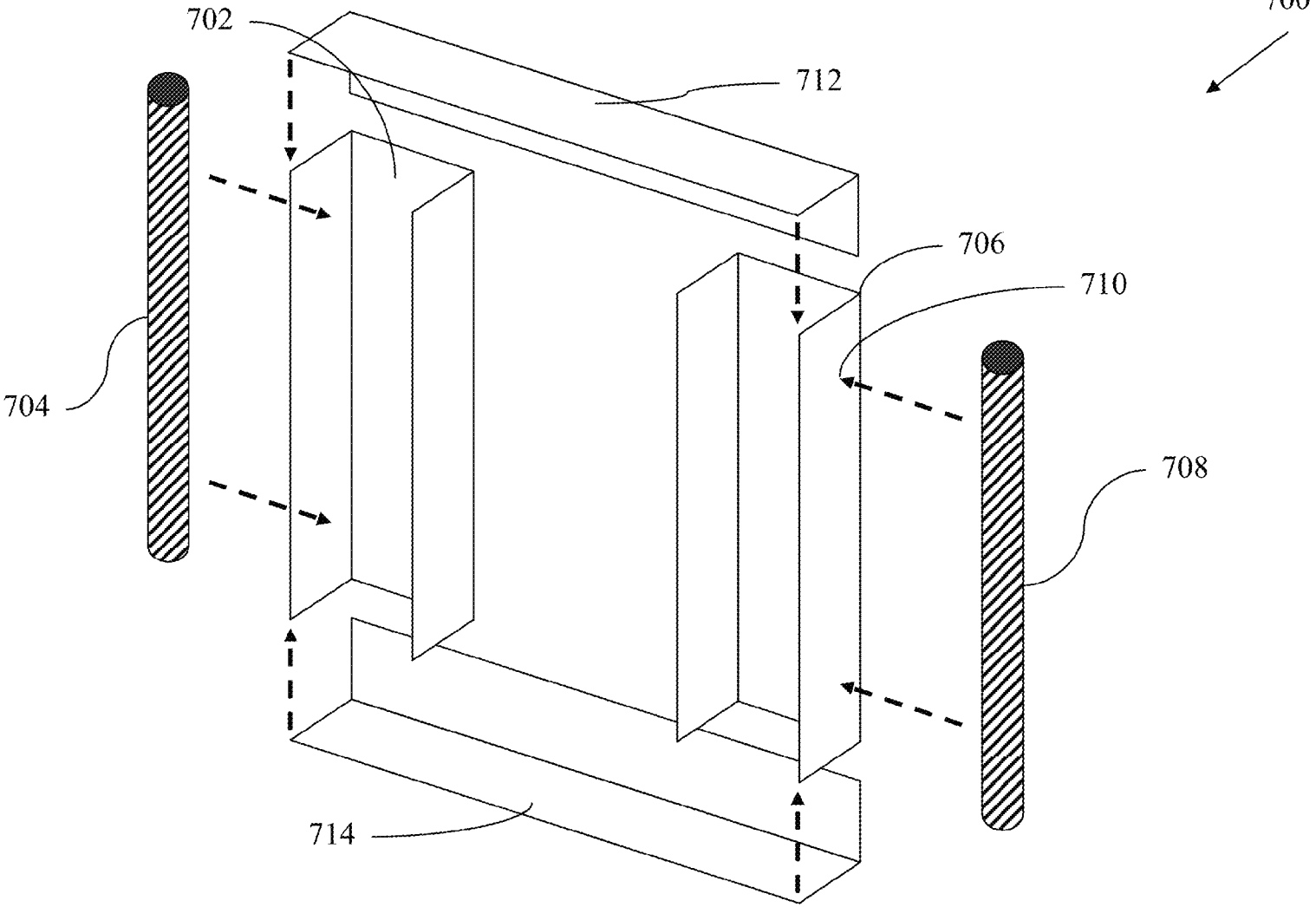
FIG. 7A illustrates another configuration of channel elements used in a chassis for a mirror, according to embodiments of the invention.

FIG. 7A illustrates, generally at 700, another configuration of channel elements used in a chassis for a mirror, according to embodiments of the invention. With reference to FIG. 7A, another configuration of a channel element is presented therein in an exploded view of a chassis. A channel element 702 is coupled to a channel element 712 at their respective ends over coupling areas. Attachment patterns can be provided and fastening can be done using holes or slots with fasteners or by welding. The channel element 712 is coupled to a channel element 710 in a similar fashion as with the channel element 702. Likewise a channel element 714 is attached to the channel elements 702 and 710.

A light element 704 is associated with the channel element 702. A light element 708 is associated with the channel element 710. The chassis thus illustrated is used as a mounting structure for a mirror platform (not shown). The light elements 704 and 708 provide a source of light to provide back light illumination for the mirror platform.

Figure 7B:
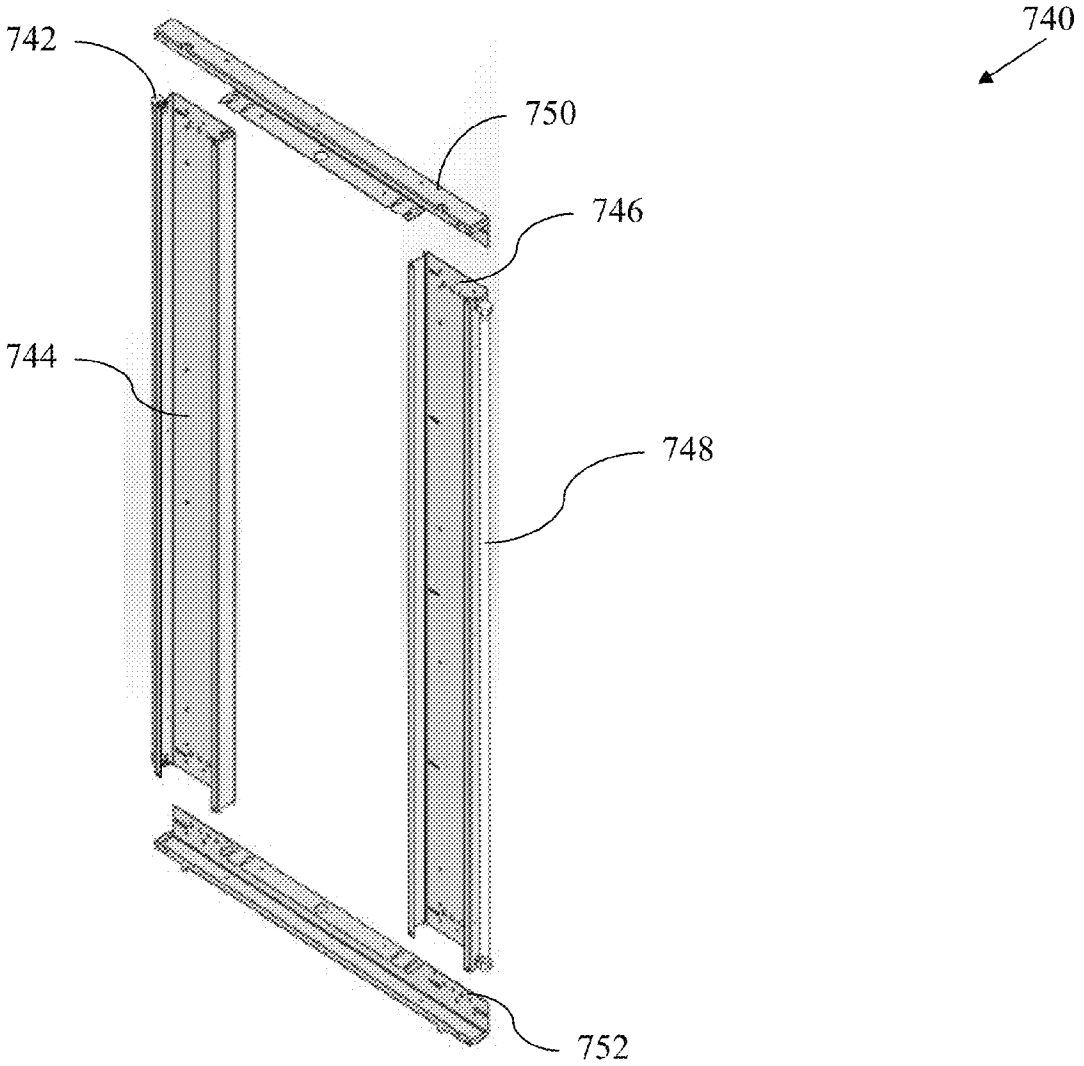
FIG. 7B illustrates a computer rendered exploded view of channel elements according to yet other embodiments of the invention.

FIG. 7B illustrates, generally at 740, a computer rendered exploded view of channel elements according to yet other embodiments of the invention. With reference to FIG. 7B, a channel element 746 has mounted thereon a light element 748. Similarly, a channel element 744 has mounted thereon a light element 742. A channel element is shown at 750 and a channel element is shown at 752.

Figure 7C:
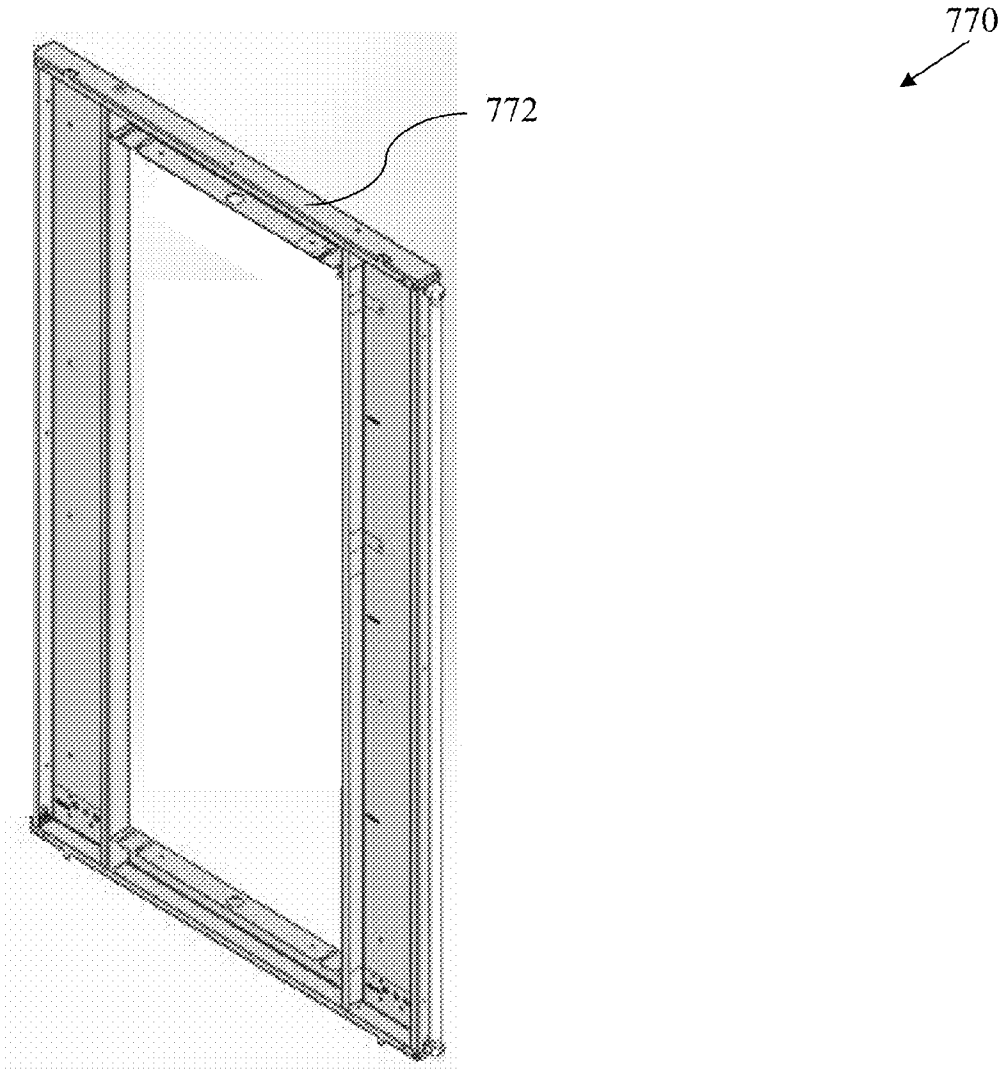
FIG. 7C illustrates a computer rendered assembled view of the channel elements from FIG. 7B according to embodiments of the invention.

FIG. 7C illustrates, generally at 770, a computer rendered assembled view of the channel elements from FIG. 7B according to embodiments of the invention. With reference to FIG. 7C, an assembled chassis with associated light elements is shown at 772.

Figure 8A:
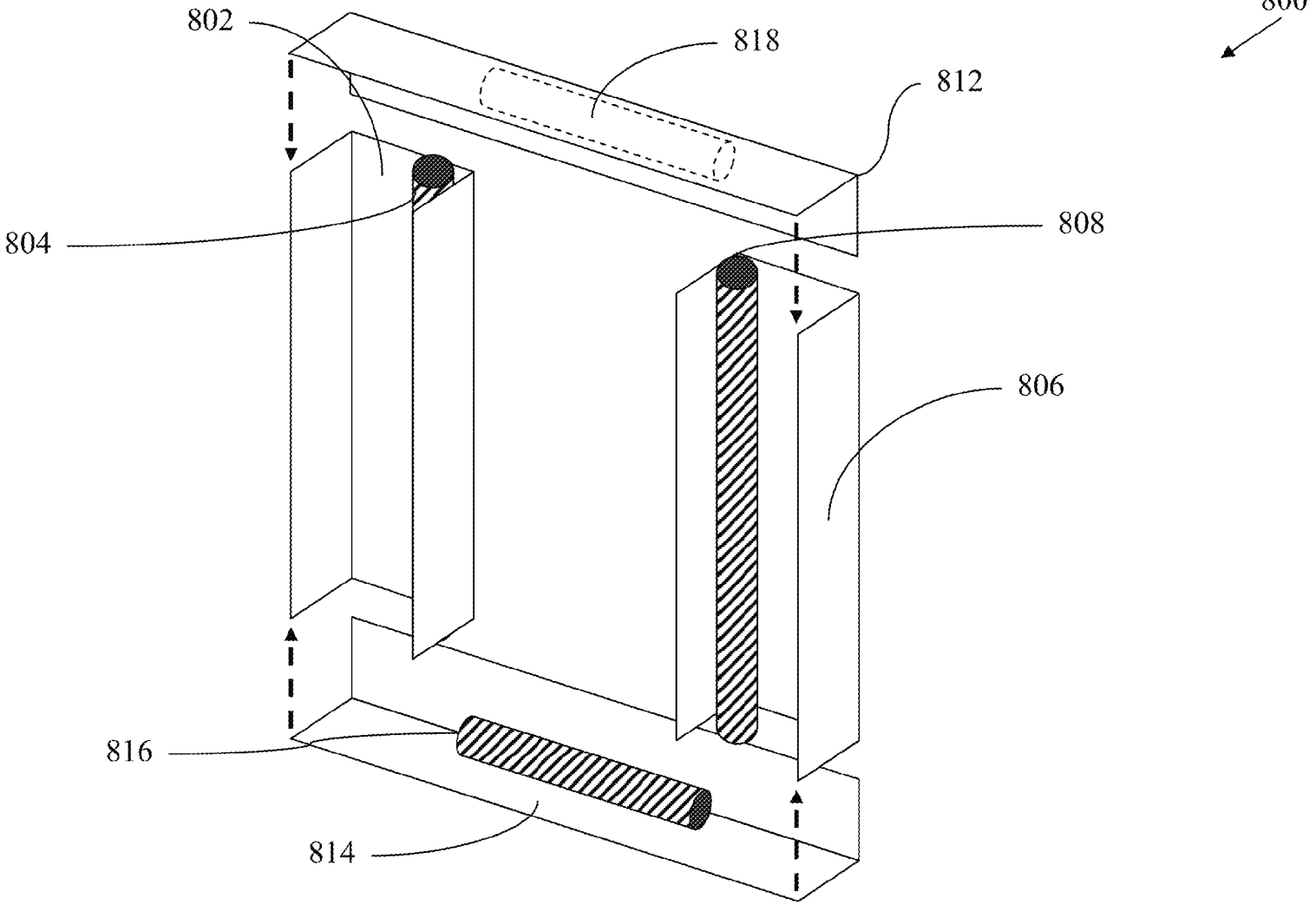
FIG. 8A illustrates another configuration of channel elements with different light element placement used in a chassis for a mirror, according to embodiments of the invention.

FIG. 8A illustrates, generally at 800, another configuration of channel elements with different light element placement used in a chassis for a mirror, according to embodiments of the invention. With reference to FIG. 8A, a channel element 802 has associated therewith a light element 804. The light element 804 is located interior to the channel element 802 as opposed to an exterior location as was illustrated in FIG. 7A with 704 and 702. Location interior to the channel element as illustrated in FIG. 8A eliminates the need for a light wing behind the light element 804, since the channel element 802 extends behind the light element 804, thereby providing a surface from which light will reflect and be directed toward the mirror platform (not shown) that is mounted on the chassis. A length of the light element 804 is used to establish a length of the channel element 802.

A light element 808 is mounted within a channel element 806. A channel element 812 couples with channel elements 802 and 806. Similarly, a channel element 814 couples with the channel elements 802 and 806 over coupling areas. Coupling is facilitated using any of the various methods described above.

Optionally, a light element 818 is coupled with the channel element 812 and a light element 816 is optionally coupled with the channel element 814. The light element 816 provides a source of light that can pass through an optional opening such as that shown in 872*b* (FIG. 8C). Note that the light element 816 can be shorter than the relative length of the light elements shown in FIG. 8A. For example, when the light element 816 is employed for use as a night light its length can be a fraction of that shown in FIG. 8A. Note further that in some embodiments, more than one light element can be located within a channel element. Therefore, the light element 816 can be mounted to the channel element 814 and a second light element (not shown) can be mounted to the channel element 814. One light element can be used to contribute to the back light provided to the mirror platform and the other light element can be used for the night light function. The light element used for the night light function can be either lower in power of both shorter in length and lower in power than the other light element.

Figure 8B:
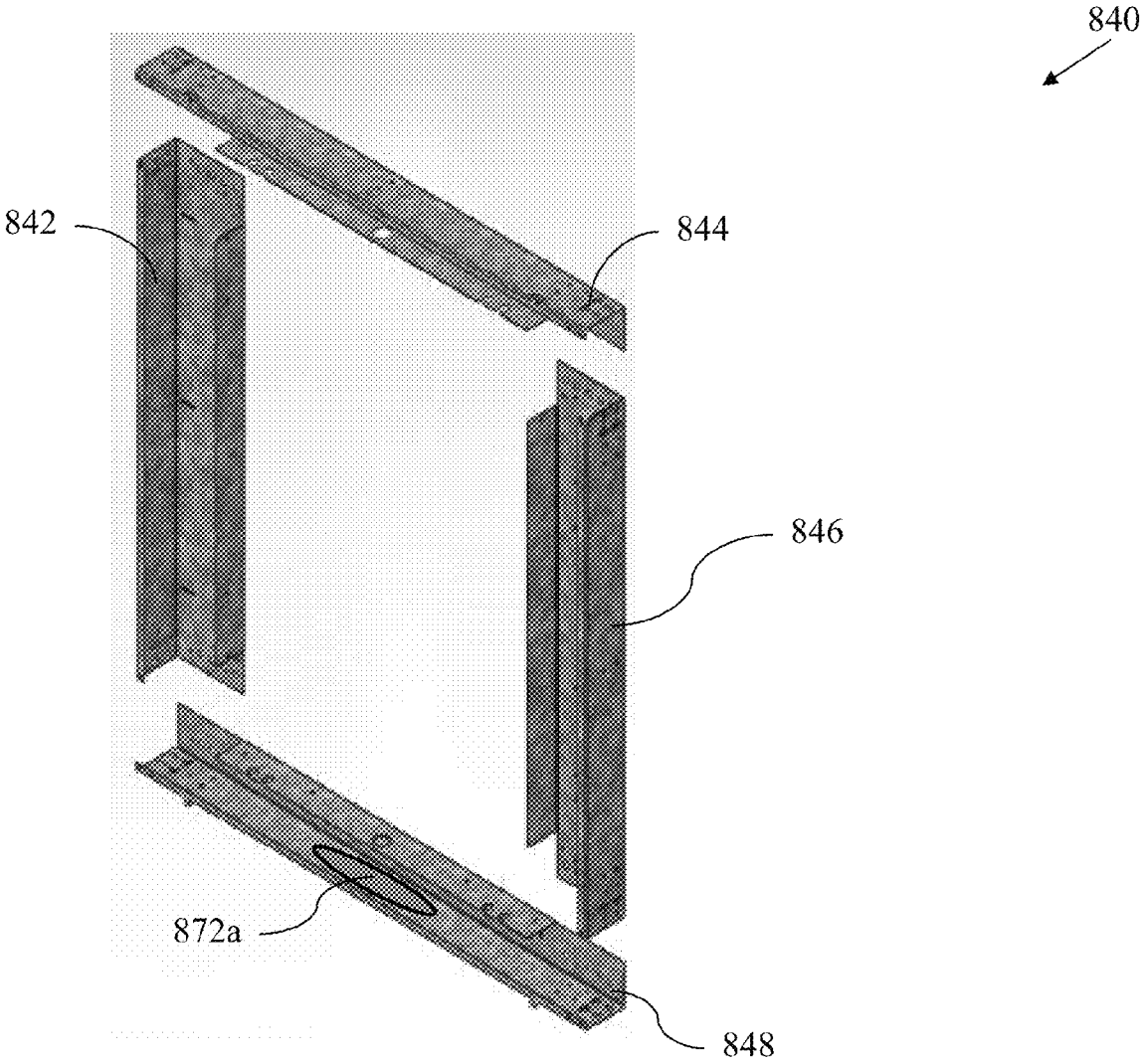
FIG. 8B illustrates a computer rendered exploded view of channel elements according to various embodiments of the invention.
Figure 8C:
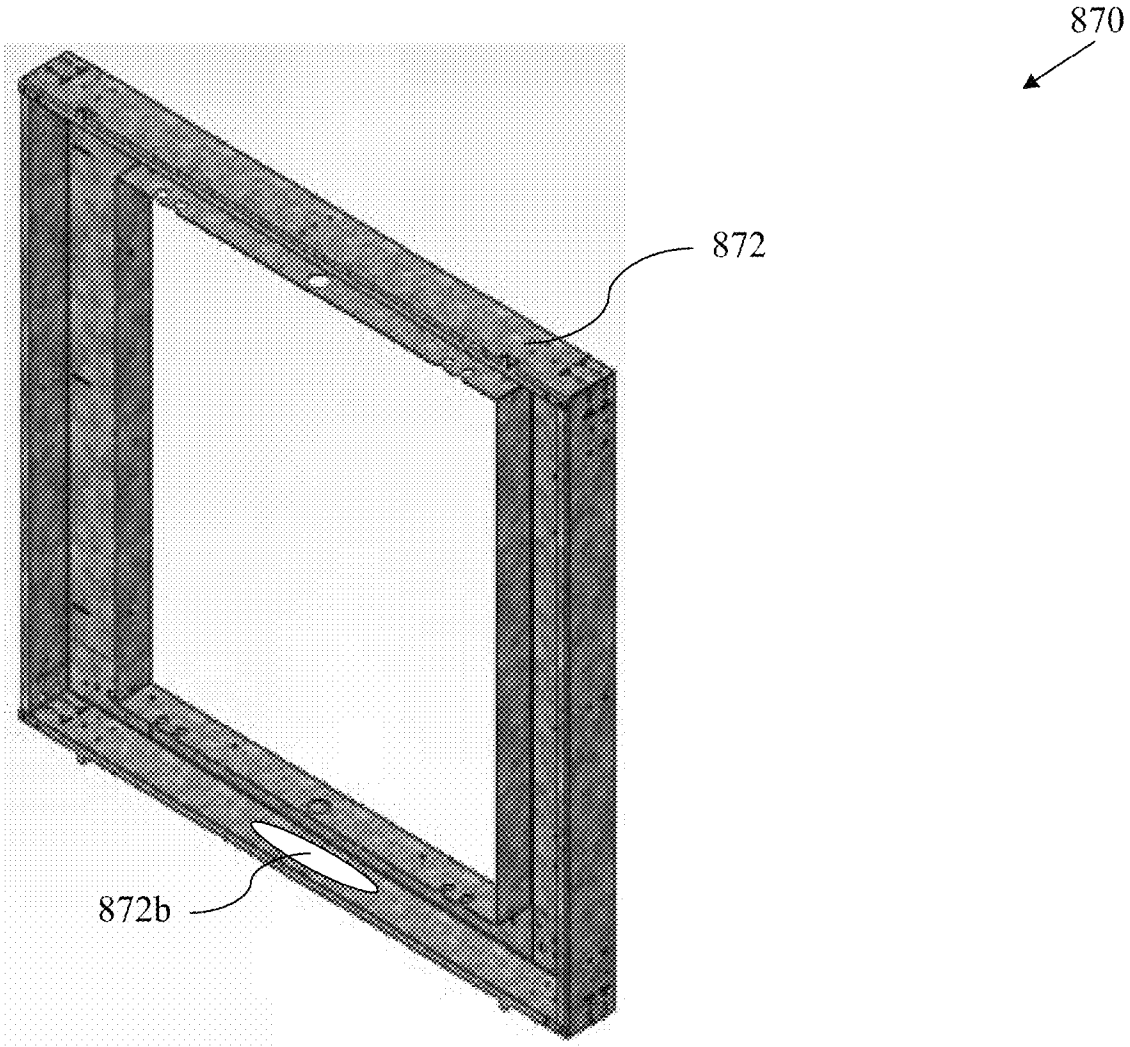
FIG. 8C illustrates a computer rendered assembled view of the channel elements from FIG. 8B according to embodiments of the invention.

FIG. 8B illustrates, generally at 840, a computer rendered exploded view of channel elements according to various embodiments of the invention. With reference to FIG. 8B, channel elements 842, 844, 846, and 848 are shown in exploded view. An optional accessory knockout is also shown in FIG. 8B at 872*a*. Knockout 872*a* is a portion of the channel element 848 which can be removed thereby exposing an opening through which light can pass. Such an opening provides a source of illumination and can provide a night light function to the mirror.

FIG. 8C illustrates, generally at 870, a computer rendered assembled view of the channel elements from FIG. 8B according to embodiments of the invention. With reference to FIG. 8C, the channel elements 842, 844, 846, and 848 (from FIG. 8B) are illustrated in assembled form at 872. Note that the knockout panel 872*a* (FIG. 8B) has been removed resulting in an opening 872*b* within the channel element (FIG. 8C).

Figure 9A:
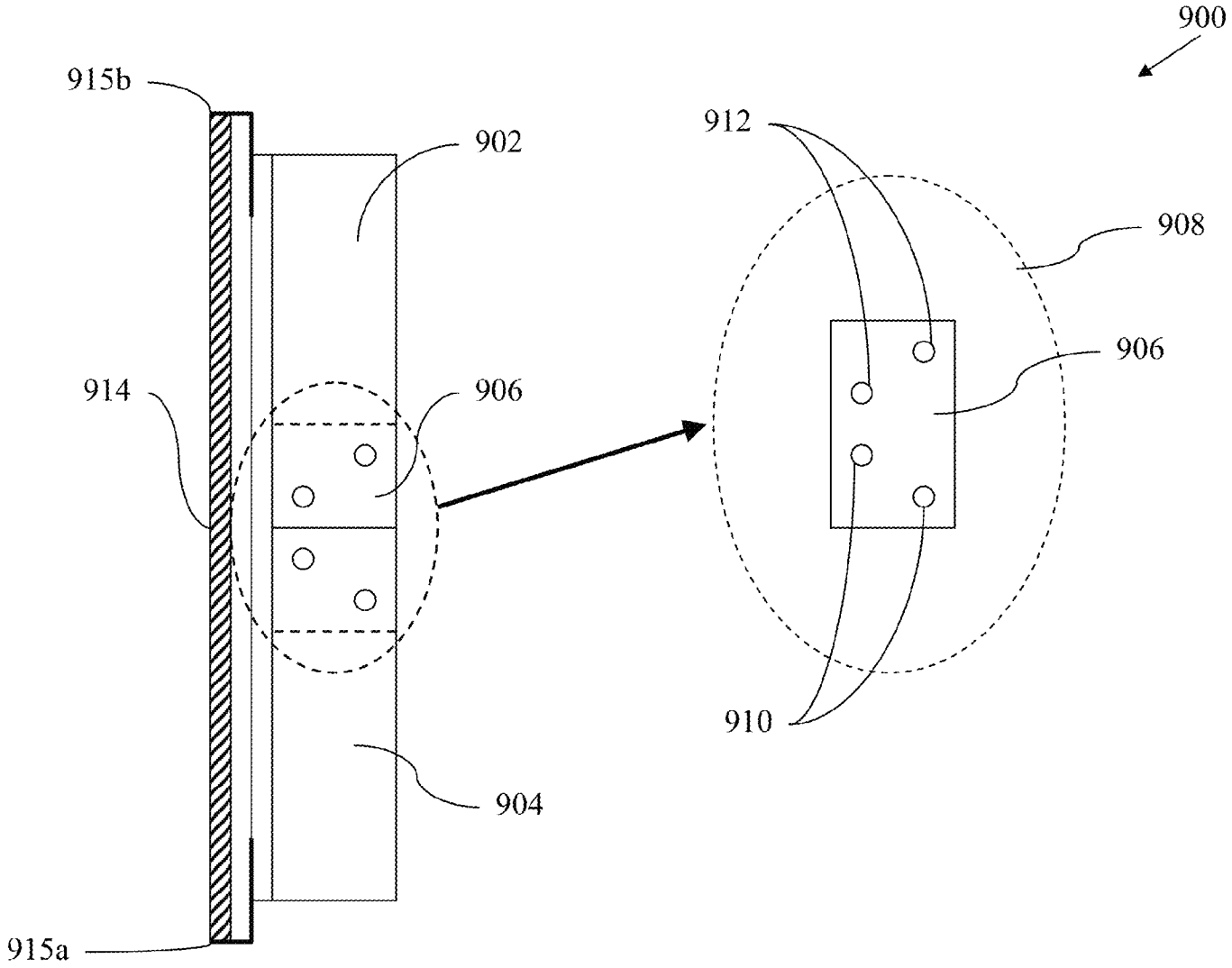
FIG. 9A illustrates extending a length of a channel element with a joining plate according to embodiments of the invention.

FIG. 9A illustrates, generally at 900, extending a length of a channel element with a joining plate according to embodiments of the invention. With reference to FIG. 9, a first channel element 902 is coupled to a second channel element 904 with a coupling element 906. As indicated within the inset view 908, the coupling element 906 can have located thereon multiple coupling areas, each with an attachment pattern. A first attachment pattern includes holes 912 and a second attachment pattern includes holes 910. The alignment patterns on the coupling element 906 align with the respective alignment patterns on coupling element 902 and 904, thereby permitting the first channel element 902 to be joined with the second channel element 904.

A light element 914 is associated with the combined channel elements 902/904. A length of the light element 914 is used to establish a length of the combined channel elements 902/904. The light element 914 is secured to the combined channel elements 902/904 with a bracket 915*a* and a bracket 915*b*.

Figure 9B:
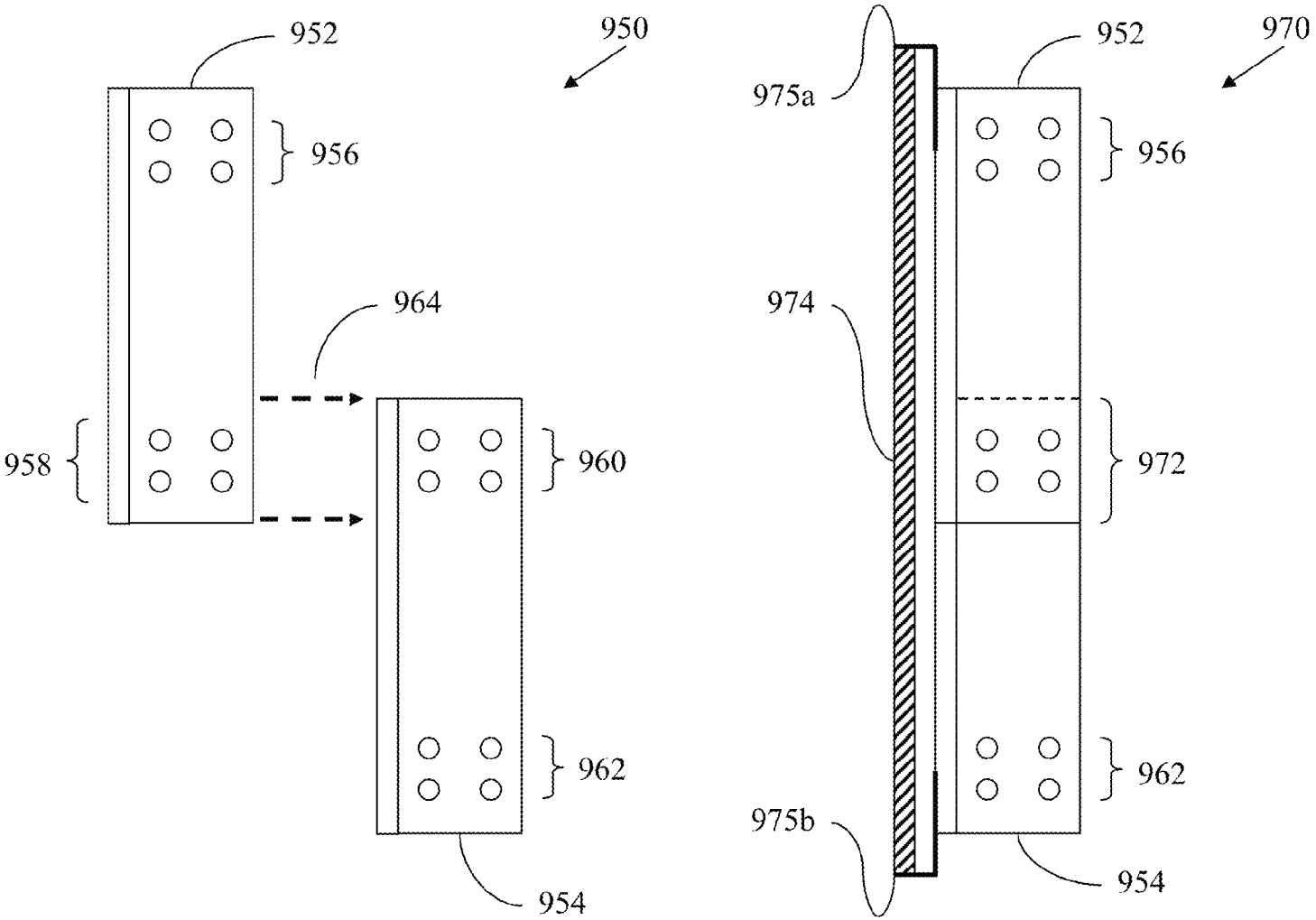
FIG. 9B illustrates extending a length of a channel element without using a joining plate according to embodiments of the invention.

FIG. 9B illustrates, generally at 950, extending a length of a channel element without using a joining plate according to embodiments of the invention. With reference to FIG. 9B, two channel elements are illustrated in a non-overlapping position in 950 and then in an overlapping position in 970. A first channel element is indicated at 952 having coupling areas at each end. A first coupling area is indicated at 956 and a second coupling area is indicated at 958. The first coupling area 956 has an attachment pattern consisting of four holes. The second coupling area 958 has an attachment pattern which includes four holes. Both of the attachment patterns are symmetric about mutually perpendicular axes, which allows the first channel element to be mounted either in line with or perpendicular to the second channel element. Direction arrow 964 indicates movement to provide overlap between the first channel element and the second channel element as shown in 970 after the movement.

In 970 the first channel element 952 overlaps the second channel element over a coupling area indicated at 972. Within the coupling area 972 four holes are provided to facilitate fastening the channel elements together. A variety of fasteners can be used in the coupling, such as but not limited to, a rivet, a pin, a wire, a screw, a bolt, a weld, a snap, etc., which can be used to fasten the channel elements together. Alternatively, the first channel element and the second channel element can be arranged at a right angle there between and fastened together.

Figure 10:
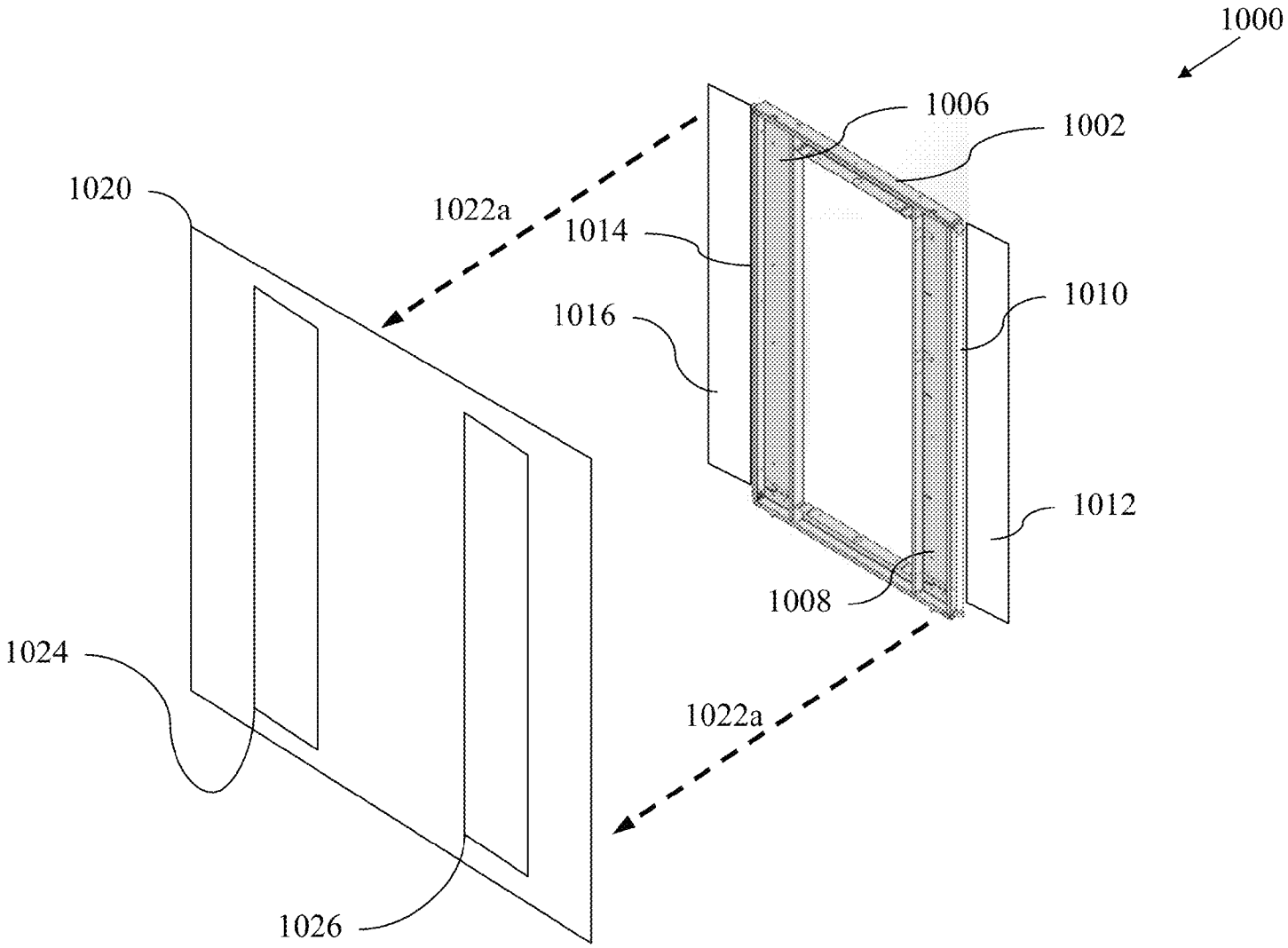
FIG. 10 illustrates mounting a mirror platform to a chassis of a mirror according to embodiments of the invention.
Figure 10A:
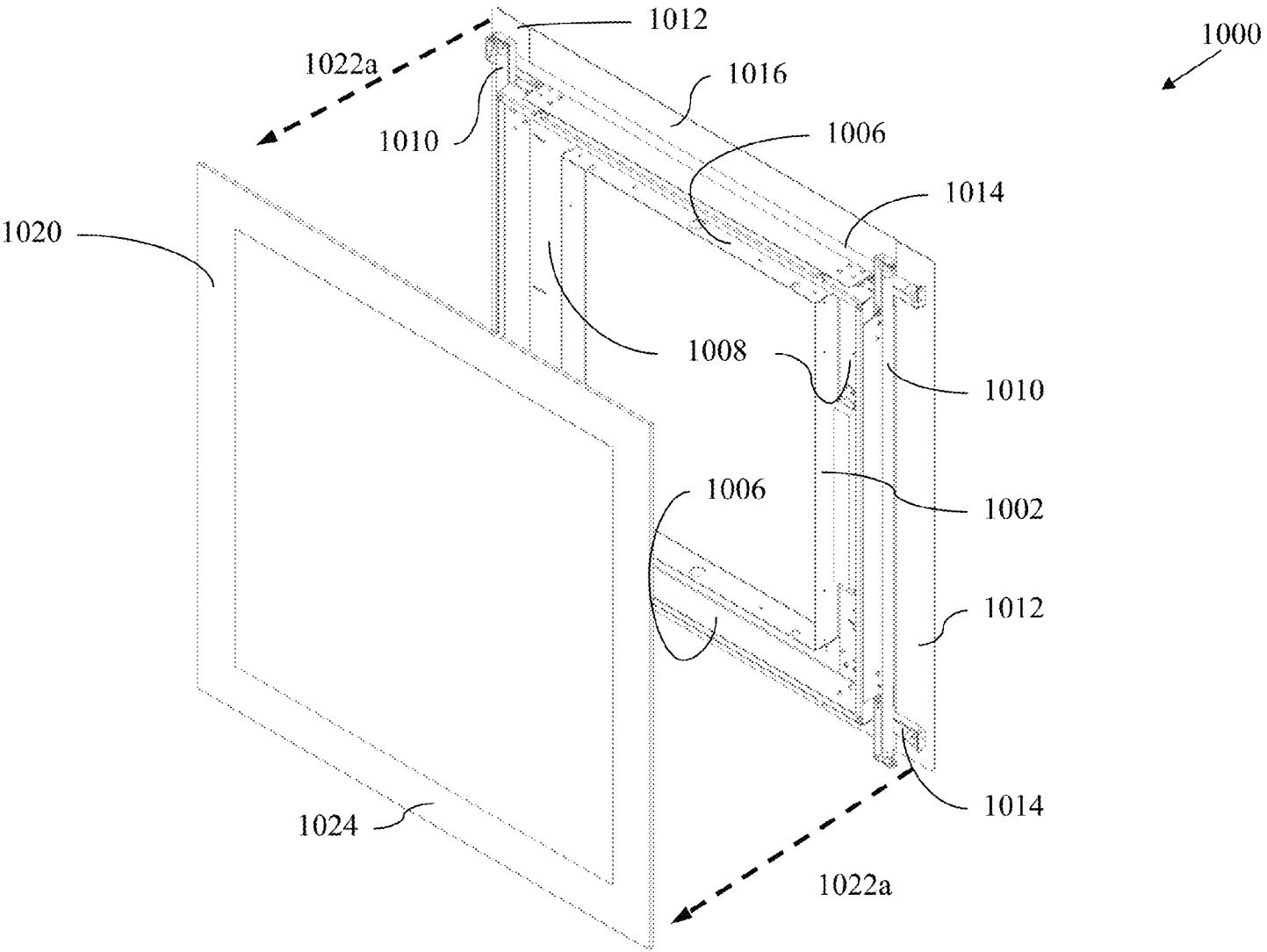
Figure 10B:
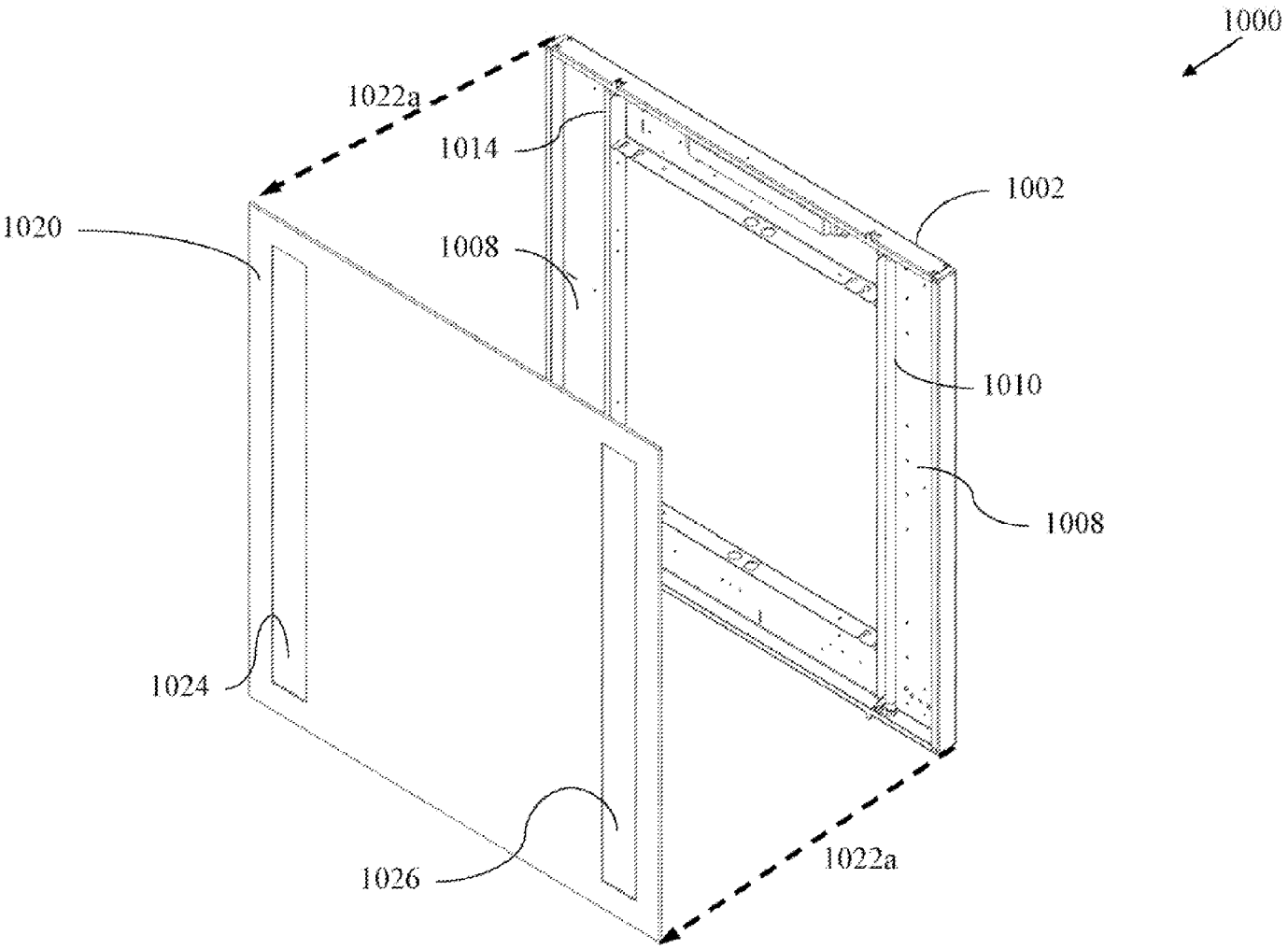
Figure 10C:
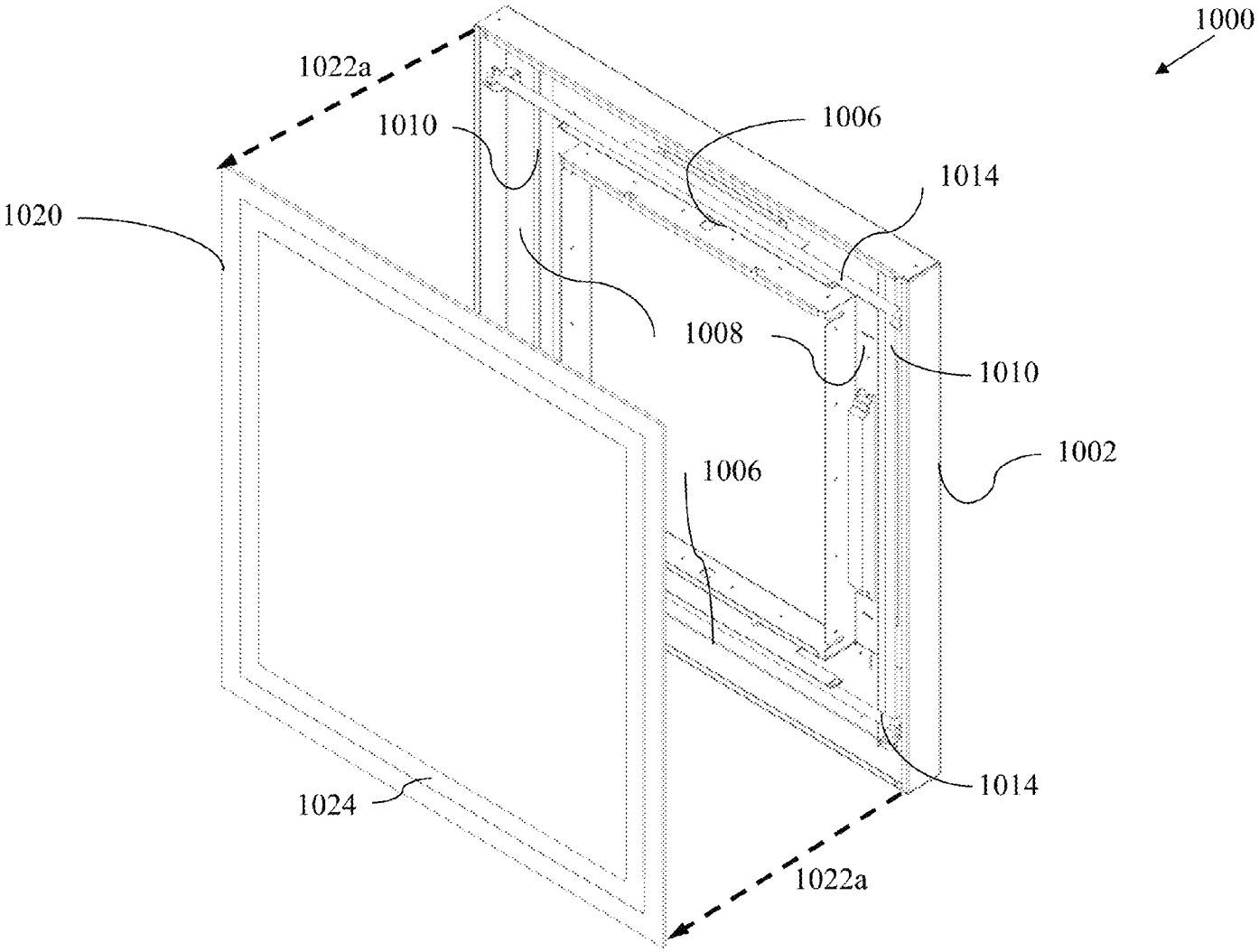
Figure 10D:
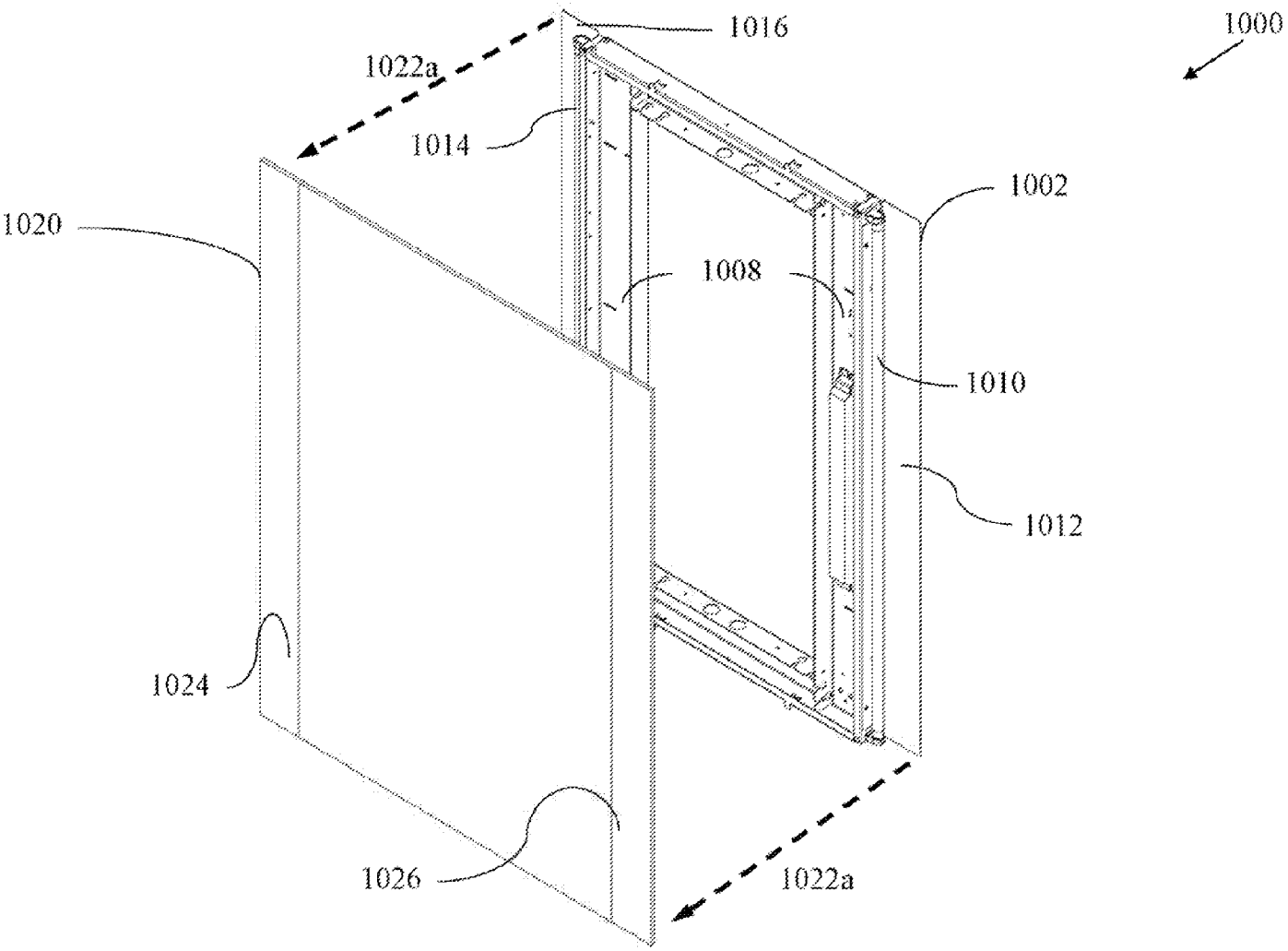

FIG. 10 illustrates, generally at 1000, mounting a mirror platform to a chassis of a mirror according to embodiments of the invention. With reference to FIG. 10, a chassis 1002 is made from a number of channel elements as previously described. Attached to a channel element 1006 of the chassis 1002 is a light element 1014. Mounted behind the light element 1014 is a light wing 1016. Light radiating from the light element 1014 reflects off of the light wing 1016 and is directed in the direction of the mirror platform 1020. Similarly, a light element 1010 is associated with the channel element 1008 of the chassis 1002. A light wing 1012 is associated with the channel element 1008. Light radiating from the light element 1010 reflects off of the light wing 1012 and is directed in the direction of the mirror platform 1020.

Mirror platform 1020 is mounted on the chassis 1002 as indicated by assembly direction arrows 1022*a*. Assembled, as such, light can pass through regions 1024 and 1026 of the mirror platform 1020, thereby providing a lighted mirror when the light elements are turned on.

Figure 11:
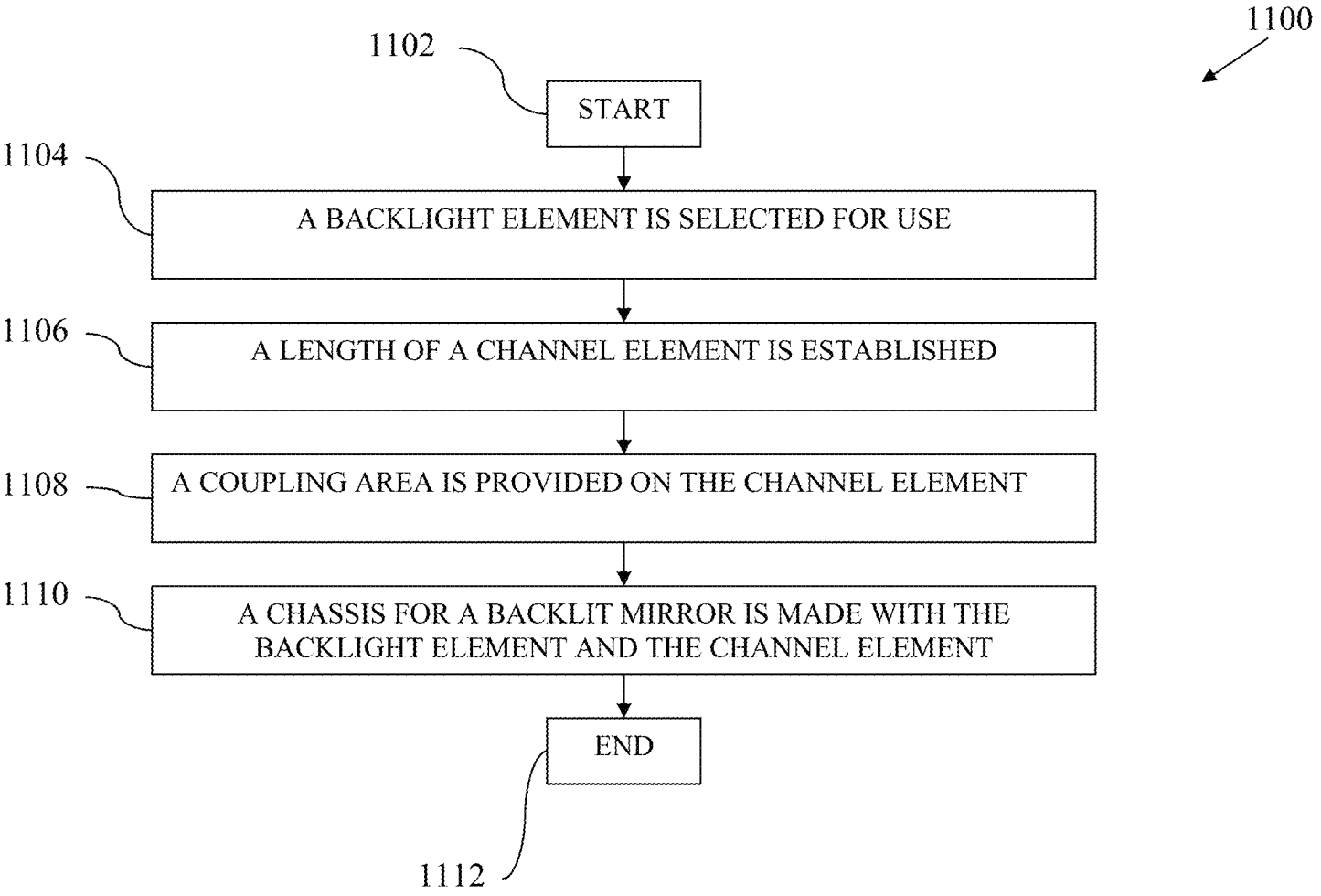
FIG. 11 illustrates a method to establish a length of a channel element, according to embodiments of the invention.

FIG. 11 illustrates, generally at 1100, a method to establish a length of a channel element, according to embodiments of the invention. With reference to FIG. 11, a method begins at a block 1102. At a block 1104 a light element is selected for use. At a block 1106 a length of a chassis element is established as influenced by a length of the light element selected in 1104. In a block 1108 a coupling area is provided on the channel element. In some embodiments, as described above multiple coupling areas can be provided. At a block 1110 a chassis for a mirror results from the aforementioned process blocks. The method ends at a block 1112.

For purposes of discussing and understanding the embodiments of the invention, it is to be understood that various terms are used by those knowledgeable in the art to describe techniques and approaches. Furthermore, in the description, for purposes of explanation, numerous specific details are set forth in order to provide a thorough understanding of the present invention. It will be evident, however, to one of ordinary skill in the art that the present invention may be practiced without these specific details. In some instances, well-known structures and devices are shown in block diagram form, rather than in detail, in order to avoid obscuring the present invention. These embodiments are described in sufficient detail to enable those of ordinary skill in the art to practice the invention, and it is to be understood that other embodiments may be utilized and that logical, mechanical, electrical, and other changes may be made without departing from the scope of the present invention.

As used in this description, "one embodiment" or "an embodiment" or similar phrases means that the feature(s) being described are included in at least one embodiment of the invention. References to "one embodiment" in this description do not necessarily refer to the same embodiment; however, neither are such embodiments mutually exclusive. Nor does "one embodiment" imply that there is but a single embodiment of the invention. For example, a feature, structure, act, etc. described in "one embodiment" may also be included in other embodiments. Thus, the invention may include a variety of combinations and/or integrations of the embodiments described herein.

While the invention has been described in terms of several embodiments, those of skill in the art will recognize that the invention is not limited to the embodiments described. The description is thus to be regarded as illustrative instead of limiting.

What is claimed is:

1. A mirror chassis apparatus comprising:

a plurality of horizontal channel elements; and a plurality of vertical channel elements, wherein a length of a channel element from the plurality of vertical channel elements and the plurality of horizontal channel elements is established using a length of a light element such that the channel element and the light element are substantially coextensive, and a horizontal channel element from the plurality of horizontal channel elements is coupleable to a vertical channel element from the plurality of vertical channel elements to form a channel for the mirror chassis.

2. The apparatus of claim 1, wherein the light element is a member of a set of light elements that are used to establish lengths of channel elements.

3. The apparatus of claim 2, further comprising:

a light wing, the light wing is coupleable to the vertical channel element, when the light element is coupled with the vertical channel element, light from the light element is reflected off of the light wing.

4. The apparatus of claim 2, further comprising:

a light wing, the light wing is coupleable to the horizontal channel element, when the light element is coupled with the horizontal channel element, light from the light element is reflected off of the light wing.

5. The apparatus of claim 2, further comprising:

coupling holes, the coupling holes are located on horizontal channel elements and vertical channel elements, the coupling holes permit channel elements to be coupled together when coupling holes are aligned.

6. The apparatus of claim 5, wherein the horizontal channel element is coupled to the vertical channel element to form a combined channel element having a length which is greater than either the length of the horizontal channel element or the length of the vertical channel element.

7. A mirror chassis apparatus comprising:

a first channel element, the first channel element has a first end and a second end and a length; and a first light element, the first light element has a length, wherein a length of the first channel element is established using the length of the first light element, such that the first channel element and the first light element are substantially coextensive, the first channel element further comprising;

a coupleable area, the coupleable area permits the first channel element to be coupled to a second channel element, wherein the mirror chassis is formed thereby.

8. The apparatus of claim 7, wherein the coupleable area has an attachment pattern.

9. The apparatus of claim 8, wherein the attachment pattern utilizes a hole.

10. The apparatus of claim 7, further comprising:

a fastener, the fastener is selected from the group consisting of a rivet, a pin, a wire, a screw, a bolt, a snap, and a weld, the fastener couples the first channel element to the second channel element.

11. The apparatus of claim 8, wherein attachment pattern utilizes a slot.

12. The apparatus of claim 7, further comprising:

a set of light elements, wherein the first light element is selected from the set of light elements.

13. The apparatus of claim 12, the apparatus further comprising:

a set of horizontal channel elements; and a set of vertical channel elements.

14. The apparatus of claim 13, wherein light elements are installed in the horizontal channel elements and are not installed in the vertical channel elements.

15. The apparatus of claim 13, wherein light elements are installed in the vertical channel elements and are not installed in the horizontal channel elements.

16. The apparatus of claim 13, wherein light elements are installed in the horizontal channel elements and in the vertical channel elements.

17. The apparatus of claim 7, wherein the first channel element is coupled to the second channel element to extend the length of the first channel element.

18. The apparatus of claim 7, wherein the first channel element extends both vertically and horizontally.

19. A method to establish a length of a channel element used in a chassis for a mirror, comprising:

selecting a first light element for use in the chassis;

establishing a length of a channel element, wherein the length is selected to permit attachment of the first light element to the channel element and the light element is substantially coextensive with the channel element; and providing a coupling area on the channel element, the coupling area permits the channel element to be coupled to a second channel element.

20. The method of claim 19, wherein the light element length is at least as large as the channel element length.

21. The method of claim 19, wherein the light element length is greater than the channel element length.

22. The method of claim 19, further comprising:

associating the channel element with the light element, wherein the associating can occur in at least two locations on the channel element.

23. The method of claim 22, further comprising:

reflecting light from the light element with a light wing, the light wing is associated with the channel element and is positioned behind the light element.

24. The method of claim 22, further comprising:

coupling the channel element to the second channel element to form the chassis for the mirror; and mounting a mirror platform on the chassis.

25. A method to establish a set of channel element lengths for a mirror chassis, comprising:

selecting a set of light element lengths; and determining a channel element length from each light element length, wherein the channel element length is selected such that a corresponding light element and a corresponding channel element are substantially coextensive.

26. The method of claim 25, further comprising:

creating the set of channel element lengths from the selecting and the determining; and associating the set of light elements with the set of channel elements to form a set of channel elements.

27. The method of claim 26, further comprising:

selecting a subset from the set of channel elements; and coupling the subset together to form the mirror chassis.

28. The method of claim 26, wherein a number of channel element lengths in the set is equal to two.

29. The apparatus of claim 1, wherein the length of the channel element is less than the length of the light element.

30. The apparatus of claim 1, wherein the length of the channel element is equal to the length of the light element.

31. The apparatus of claim 1, wherein the length of the channel element is greater than the length of the light element.

32. The apparatus of claim 7, wherein the length of the first channel element is less than the length of the first light element.

33. The apparatus of claim 7, wherein the length of the first channel element is equal to the length of the first light element.

34. The apparatus of claim 7, wherein the length of the first channel element is greater than the length of the first light element.

35. The method of claim 19, wherein the light element length is less than the channel element length.

36. The method of claim 27, further comprising:

selecting a second subset from the set of channel elements; and coupling the subset of channel elements together to form a second mirror chassis wherein dimensions of the second mirror chassis are different from dimensions of the mirror chassis.

* * * * *